US009421146B2

(12) United States Patent
Muraki et al.

(10) Patent No.: US 9,421,146 B2
(45) Date of Patent: Aug. 23, 2016

(54) COSMETIC DEVICE

(71) Applicant: Panasonic Intellectual Property Management Co., Ltd., Osaka (JP)

(72) Inventors: Kenichi Muraki, Shiga-ken (JP); Tetsuro Hashiguchi, Shiga-ken (JP); Kazuyasu Ikadai, Shiga-ken (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/527,593

(22) Filed: Oct. 29, 2014

(65) Prior Publication Data

US 2015/0132041 A1 May 14, 2015

(30) Foreign Application Priority Data

Nov. 14, 2013 (JP) ..... 2013-236118

(51) Int. Cl.
*A46B 11/00* (2006.01)
*A61H 7/00* (2006.01)
(Continued)

(52) U.S. Cl.
CPC ..... *A61H 7/005* (2013.01); *B01F 3/04453* (2013.01); *B01F 7/00891* (2013.01); *B01F 13/002* (2013.01); *A45D 26/00* (2013.01); *A45D 2019/005* (2013.01); *A45D 2019/0041* (2013.01); *A45D 2200/058* (2013.01); *A61H 2201/0107* (2013.01); *A61H 2201/105* (2013.01); *A61H 2201/1215* (2013.01); *A61H 2201/1463* (2013.01); *A61H 2201/1695* (2013.01); *A61H 2205/021* (2013.01)

(58) Field of Classification Search
CPC ..... A45D 27/02; A45D 27/06; A45D 27/12; A46B 2200/058; A46B 2200/102; A46B 2200/1033; A46B 11/002; A46B 13/04; A47K 7/04; A67H 7/004; B01F 3/04453; B01F 7/00891
USPC ..... 401/4
See application file for complete search history.

(56) References Cited

U.S. PATENT DOCUMENTS 3,210,790 A * 10/1965 Neumann ..... A47K 7/028 15/118
3,906,574 A 9/1975 Kaeser
(Continued)

FOREIGN PATENT DOCUMENTS

CN 2170092 Y 6/1994
CN 101014265 A 8/2007
(Continued)

OTHER PUBLICATIONS

European Search Report dated Apr. 15, 2015 issued in European Patent Application No. 14190457.3.
(Continued)

*Primary Examiner* — Jennifer C Chiang
(74) *Attorney, Agent, or Firm* — McDermott Will & Emery LLP

(57) ABSTRACT

A cosmetic device includes a bubble generator configured to generate bubbles, a cosmetic unit configured to exert a cosmetic effect on a skin, and a motor configured to drive at least the cosmetic unit. The bubble generator includes an agitating and mixing mechanism configured to agitate a liquid foaming agent and mix the agitated liquid foaming agent with air.

18 Claims, 22 Drawing Sheets

(51) Int. Cl.

| | |
|---|---|
| ***B01F 7/00*** | (2006.01) |
| ***B01F 13/00*** | (2006.01) |
| ***B01F 3/04*** | (2006.01) |
| *A45D 19/00* | (2006.01) |
| *A45D 26/00* | (2006.01) |

(56) References Cited

U.S. PATENT DOCUMENTS

| | | | | |
|---|---|---|---|---|
| 7,788,757 | B2 * | 9/2010 | Lei | A46B 5/0095 15/105 |
| 2005/0278876 | A1 | 12/2005 | Roth et al. | |
| 2007/0293794 | A1 | 12/2007 | Siegrest et al. | |
| 2008/0234611 | A1 | 9/2008 | Sakai et al. | |

FOREIGN PATENT DOCUMENTS

| | | | |
|---|---|---|---|
| EP | 1972317 | A1 | 9/2008 |
| JP | 58-022555 | A | 2/1983 |
| JP | 2008-296965 | A | 12/2008 |

OTHER PUBLICATIONS

Chinese Office Action dated Dec. 21, 2015 issued in Chinese Office Action 201410614492.3.

* cited by examiner

COSMETIC DEVICE

CROSS-REFERENCE TO RELATED APPLICATIONS

This application is based upon and claims the benefit of priority from prior Japanese Patent Application No. 2013-236118, filed on Nov. 14, 2013, the entire contents of which are incorporated herein by reference.

FIELD

The present invention relates to a cosmetic device that generates bubbles from a liquid foaming agent and air.

BACKGROUND

Japanese Laid-Open Patent Publication Nos. 2008-296965 and 58-22555 disclose an example of a conventional cosmetic device. The cosmetic device of Publication No. 2008-296965 includes a container, a pump, and a mesh body. The pump mixes a liquid foaming agent stored in the container with air. When the gas and liquid mixture passes through the mesh body, bubbles are generated and sent to a brush. A user can supply the bubbles discharged from the brush of the cosmetic device to a target site such as a skin.

The cosmetic device described in Publication No. 58-22555 includes a brush and a motor. The brush rotates on the basis of driving of a motor. In the cosmetic device, the user is able to clean a target site by bringing the brush into contact with the target site such as a skin.

By using a driving source such as a motor described in Publication No. 58-22555, it is possible to electrically drive a manual drive unit such as a pump described in Publication No. 2008-296965.

SUMMARY

In the liquid foaming agent, there is unevenness in a degree of mixing between liquid and a foaming agent. In this case, unevenness occurs in the size of the bubbles generated from the liquid foaming agent, and the diameters of the bubbles are relatively large. When such bubbles are supplied to the skin from the cosmetic device, a desired cosmetic effect may not be obtained.

Furthermore, the degree of mixing between the liquid foaming agent and air is affected by the concentration of the foaming agent in the liquid foaming agent. If the concentration of the foaming agent is high, the liquid foaming agent and air are less likely to be uniformly mixed with each other. Even in this case, a desired cosmetic effect may not be obtained.

A cosmetic device according to one aspect includes a bubble generator configured to generate bubbles, a cosmetic unit configured to exert the cosmetic effect on the skin, and a motor configured to drive at least the cosmetic unit. The bubble generator includes an agitating and mixing mechanism configured to agitate a liquid foaming agent and mix the agitated liquid foaming agent with air.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DESCRIPTION OF THE EMBODIMENTS

Figure 1:
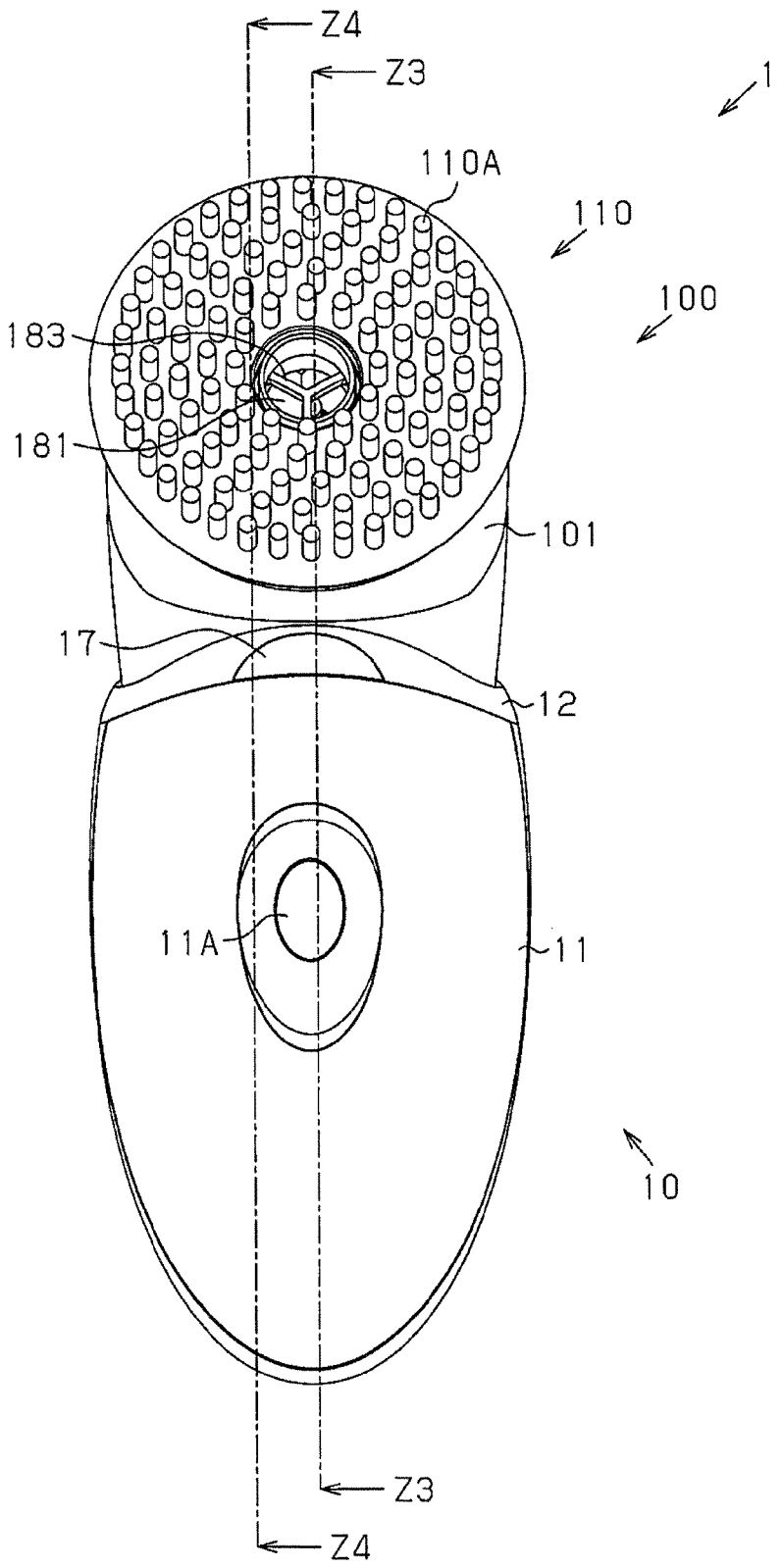
FIG. 1 is a front view of a cosmetic device according to a first embodiment.

First, characteristics of a cosmetic device according to this disclosure will be described.

In one aspect, the cosmetic device includes a bubble generator configured to generate bubbles, a cosmetic unit configured to exert a cosmetic effect on a skin, and a motor configured to drive at least the cosmetic unit. The bubble generator includes an agitating and mixing mechanism configured to agitate a liquid foaming agent and mix the agitated liquid foaming agent with air.

According to the cosmetic device, the agitating and mixing mechanism mechanically agitates the liquid foaming agent. Thus, the mixing between the liquid foaming agent and air is promoted. Thus, even when the liquid and the foaming agent are not sufficiently mixed with each other, or even when the concentration of the foaming agent is high, it is possible to suppress the unevenness of the size of the bubbles and to generate the fine bubbles.

In the cosmetic device, the agitating and mixing mechanism may preferably include at least two rotors. Furthermore, at least the two rotors may preferably include first and second rotors configured to rotate in opposite directions to each other.

According to the cosmetic device, the flow of the liquid foaming agent formed by the rotation of the first rotor and the flow of the liquid foaming agent formed by the rotation of the second rotor interfere with each other. Thus, a turbulent flow is generated by agitation of the liquid foaming agent, thereby being able to promote the mixing between the liquid foaming agent and air by the turbulent air. Consequently, it is possible to enhance the effect of suppressing the unevenness of the size of the bubbles to generate the fine bubbles.

In the cosmetic device, the agitation and mixing mechanism may preferably include at least one arm that protrudes from at least one of the first and second rotors.

According to the cosmetic device, the rotor and the arm agitate the liquid foaming agent. This increases the area of an agitating portion coming into contact with the liquid foaming agent. Accordingly, it is possible to promote the mixing between the liquid foaming agent and air.

Here, a peripheral speed of a distal end portion of the arm is greater than a peripheral speed of a basal end portion of the arm (that is, the surface of the rotor). By providing the arm, the agitation capacity at a position with a larger peripheral speed is enhanced. This enables the mixing between the liquid foaming agent and air to be further promoted. Accordingly, it is possible to enhance the effect of suppressing the unevenness of the size of the bubbles to generate the fine bubbles.

In the cosmetic device, each of the first and second rotors may preferably include at least one arm. Furthermore, in this case, it is preferred that a rotational orbit of the arm protruding from the first rotor partially overlaps a rotational orbit of the arm protruding from the second rotor.

According to the cosmetic device, the flows of the liquid foaming agent agitated by the first and second rotors interfere with each other. Thus, the turbulent flow is easily formed, and it is possible to promote the mixing between the liquid foaming agent and air. Accordingly, it is possible to enhance the effect of suppressing the unevenness of the size of the bubbles to generate the fine bubbles.

In the cosmetic device, the agitating and mixing mechanism may preferably include a pillar that is coupled to the arm and bent with respect to the arm.

According to the cosmetic device, the rotor, the arm, and the pillar agitate the liquid foaming agent. This increases the area of the agitating portion coming into contact with the liquid foaming agent. Consequently, it is possible to promote the mixing between the liquid foaming agent and air. Accordingly, it is possible to enhance the effect of suppressing the unevenness of the size of the bubbles to generate the fine bubbles.

In the cosmetic device, the pillar may preferably have a shape tapered toward a rotational direction of the corresponding rotor.

According to the cosmetic device, the pillar rotates to cut the liquid foaming agent with the rotation of the rotor. Thus, the turbulent flow easily occurs, and it is possible to promote the mixing between the liquid foaming agent and air. Accordingly, it is possible to enhance the effect of suppressing the unevenness of the size of the bubbles to generate the fine bubbles.

In the cosmetic device, the bubble generator includes a discharge port configured to discharge the bubbles. In this case, it is preferred that the discharge port be arranged so that a center of the discharge port is located at a position which is offset from a line segment connecting the rotational center axes of the first and second rotors and at which the liquid foaming agent agitated by the first and second rotors is converged.

According to this structure, the flow of the liquid foaming agent strongly interferes at the center of the discharge port. Thus, the bubbles are easily formed at the center of the discharge port. Consequently, the bubbles may be more easily and continuously discharged from the discharge port.

In the cosmetic device, the bubble generator includes a suction port configured to suck air. In this case, it is preferred that the suction port is arranged so that a center of the suction port is located at a position which is offset from a line segment connecting the rotational center axes of the first and second rotors and at which the liquid foaming agent agitated by the first and second rotors is diffused.

According to this structure, the flow of the liquid foaming agent does not interfere at the center of the suction port. Thus, much bubble is not generated. Therefore, it is reduced that the flow of air passing through the suction port is disturbed by the bubbles. Consequently, the shortage of the air to be mixed with the liquid foaming agent is reduced. Accordingly, it is possible to enhance the effect of suppressing the unevenness of the size of the bubbles to generate the fine bubbles.

First Embodiment

Figure 2:
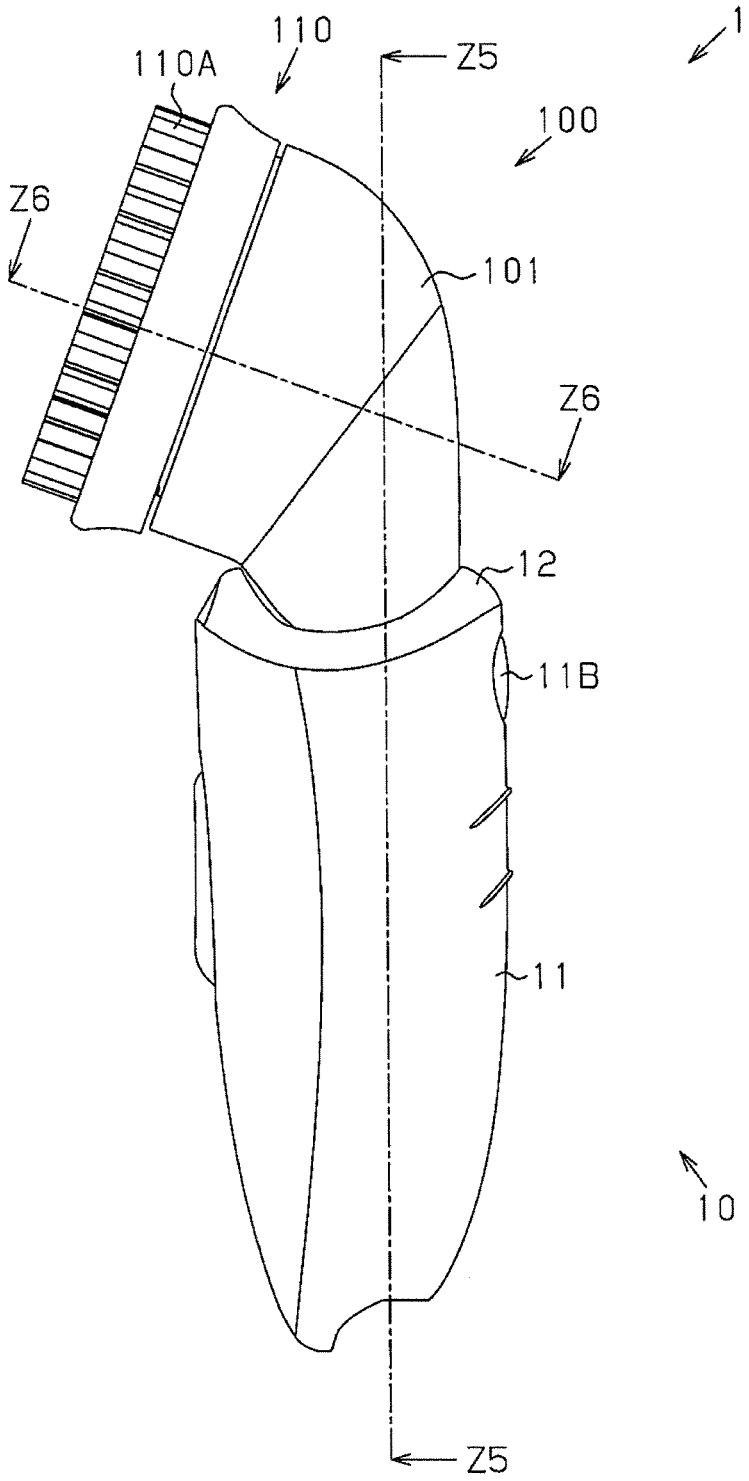
FIG. 2 is a right side view of the cosmetic device illustrated in FIG. 1.

An external structure of a cosmetic device 1 will be described referring to FIGS. 1 and 2.

The cosmetic device 1 has a structure that is suitable for suppressing unevenness of the size of the bubbles to generate a large amount of fine bubbles. Bubbles generated by the cosmetic device 1 exert a cosmetic effect on the skin. The cosmetic device 1 includes a plurality of constituent elements capable of being functionally coupled to one another. The cosmetic device 1 includes a main body block 10, a head block 100, and a head cap 20 (see FIG. 9). The head block 100 has an attachment structure that is attachable and detachable to and from the main body block 10. The head block 100 has a shape that is curved toward a distal end portion of the head block 100 from the main body block 10.

Figure 3:
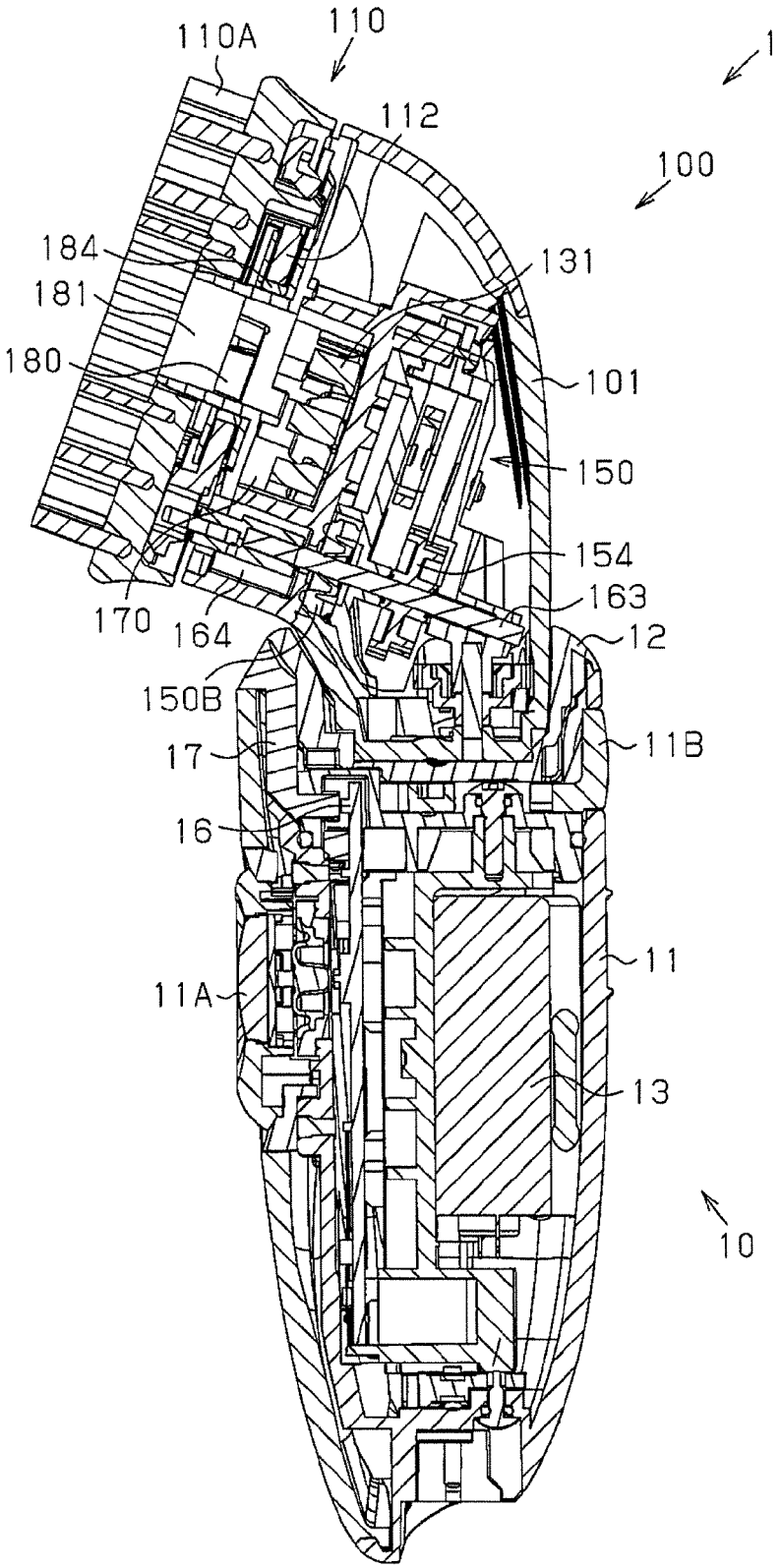
FIG. 3 is a cross-sectional view taken along a line Z3 to Z3 of FIG. 1.

An internal structure of the cosmetic device 1 will be described referring to FIGS. 3 to 5. As illustrated in FIG. 3, the main body block 10 includes a housing 11, a cap 12, a motor 13, a joint 14 (see FIG. 4), a rechargeable battery 15 (see FIG. 5), a light source 16, and a light distribution lens 17. The motor 13, the rechargeable battery 15, and the light source 16 are disposed in the internal space of the housing 11. The housing 11 has a handheld shape. The housing 11 has a waterproof structure that prevents liquid such as water from entering the interior of the housing 11.

As an example, the housing 11 and the cap 12 are made of an ABS resin. The top of the housing 11 is open. The cap 12 is fitted to the opening of the top of the housing 11.

The light source 16 has a function of irradiating the front of a brush unit 110. An example of the light source 16 is an LED lamp. The light distribution lens 17 has a function of guiding the light output from the light source 16 to the front of the brush unit 110. As an example, the light distribution lens 17 is made of a material mainly composed of glass or a transparent resin. The light distribution lens 17 is fitted between the housing 11 and the cap 12.

Figure 4:
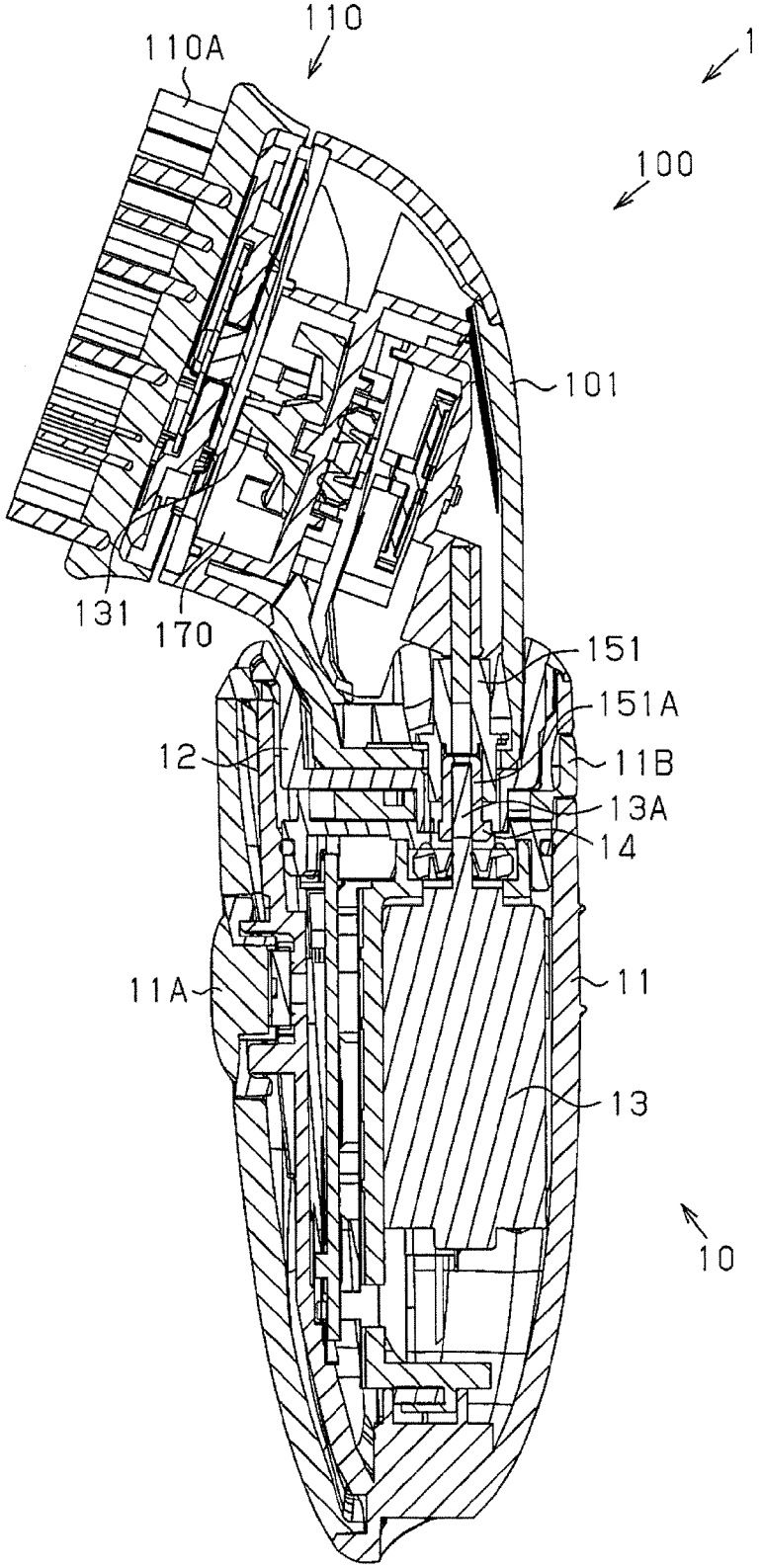
FIG. 4 is a cross-sectional view taken along a line Z4 to Z4 of FIG. 1.
Figure 5:
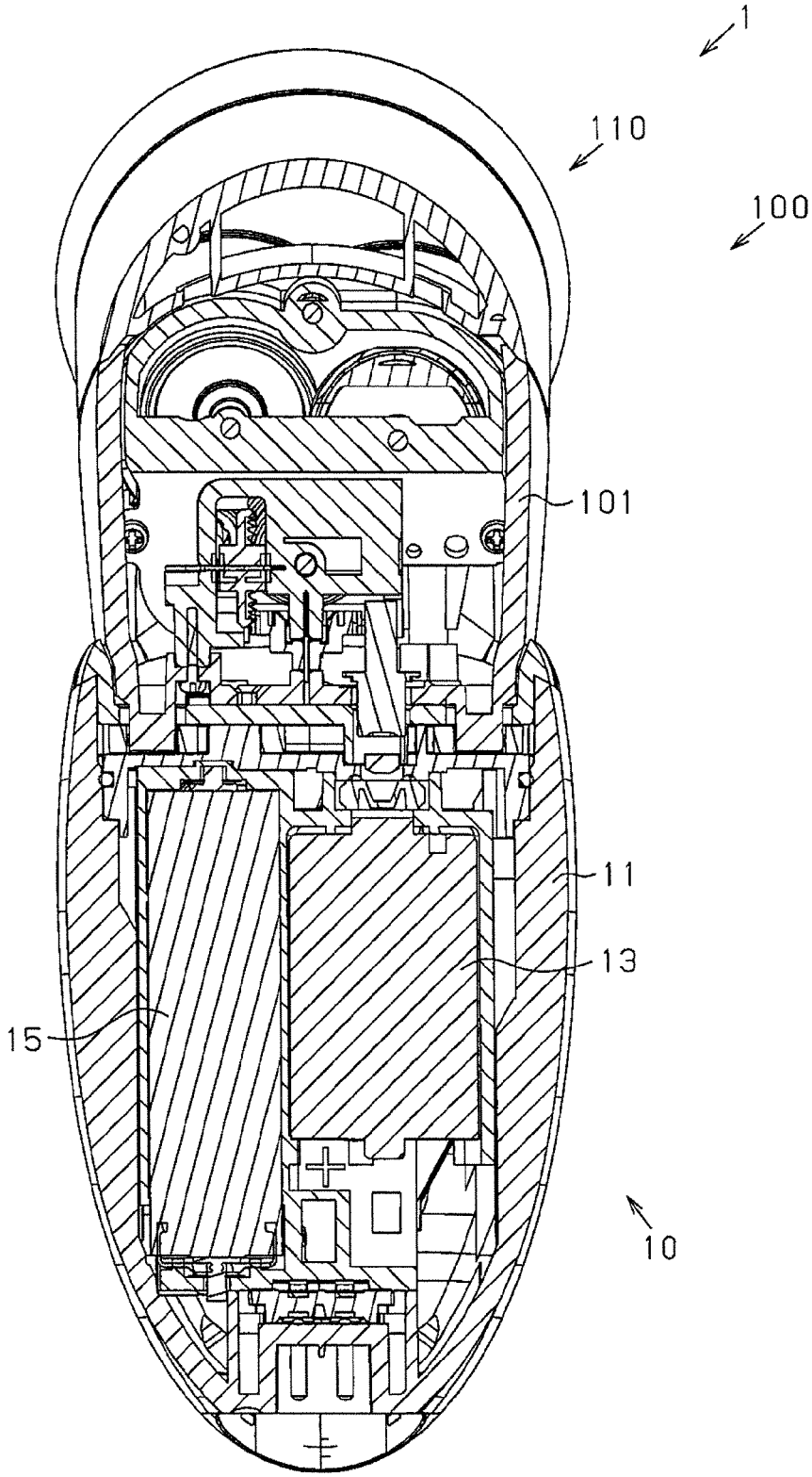
FIG. 5 is a cross-sectional view taken along a line Z5 to Z5 of FIG. 2.

As illustrated in FIG. 4, the joint 14 is fixed to an output shaft 13A of the motor 13. For example, the joint 14 has a hexagonal shape. A part of the joint 14 protrudes from the housing 11 through the hole of the cap 12.

An operation structure of the cosmetic device 1 will be described referring to FIGS. 1 and 6. A power switch 11A and a release button 11B are disposed in the housing 11. These buttons 11A and 11B are provided as a man-machine interface.

The power switch 11A is used to start the operation of the head block 100. When the power switch 11A is operated, the motor 13 is driven (see FIG. 3). When the motor 13 is driven, the light source 16 (see FIG. 3) outputs the light. The light output from the light source 16 irradiates an area around the head block 100 via the light distribution lens 17.

The release button 11B is used when separating the main body block 10 from the head block 100. The coupling between the main body block 10 and the head block 100 is released by operation of the release button 11B.

A structure of the head block 100 will be described referring to FIGS. 3, 7A, and 7B. The head block 100 is configured to be able to discharge the bubbles towards the skin and to exert the cosmetic effect on the skin. The head block 100 includes a head housing 101, a brush unit 110, and a bubble generator 120.

Figure 7A:
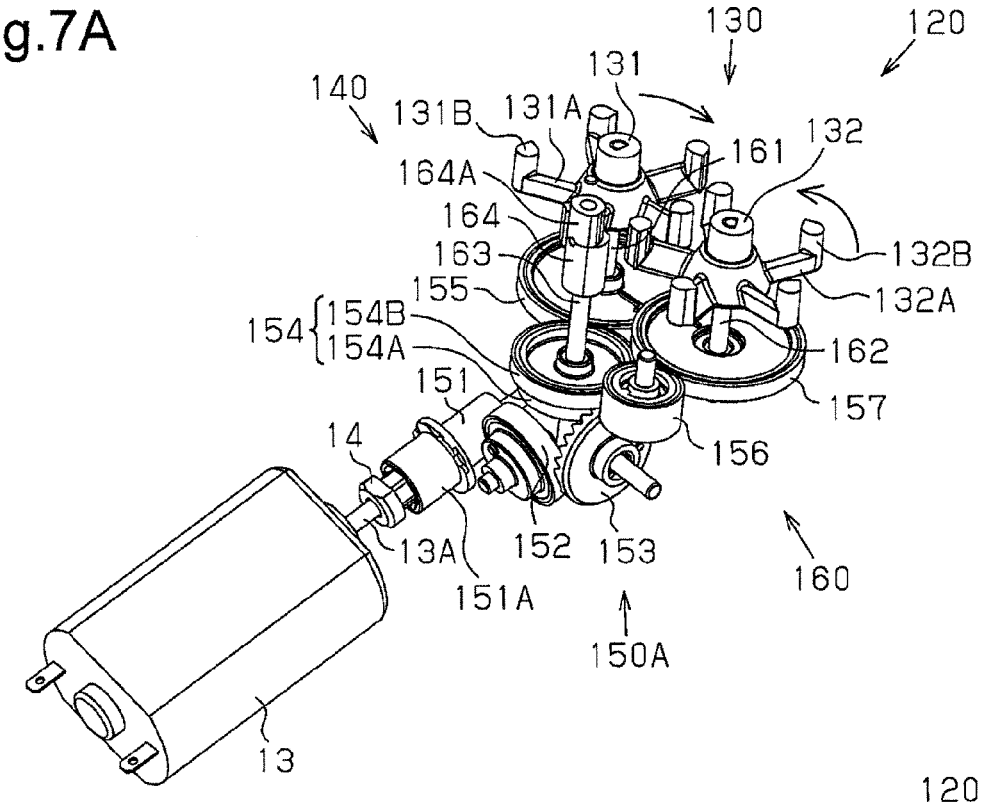
FIGS. 7A and 7B are schematic perspective views of a drive unit according to the first embodiment.
Figure 7B:
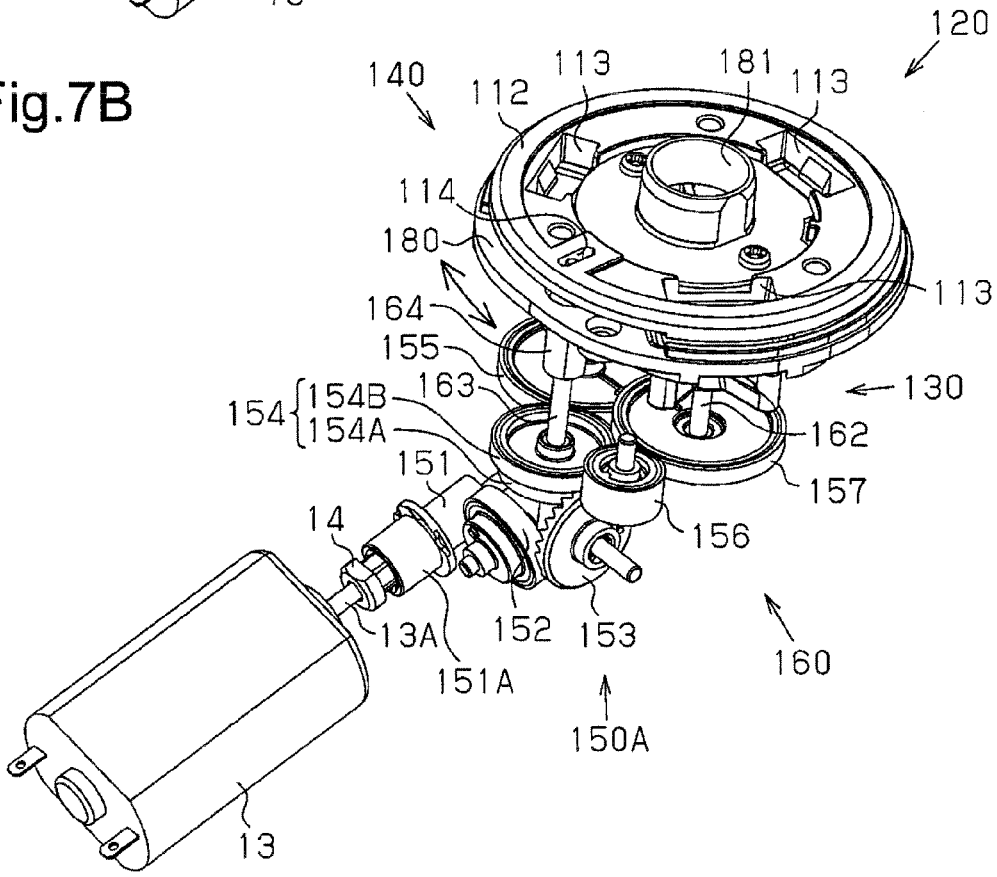

FIGS. 7A and 7B illustrate the bubble generator 120. The bubble generator 120 is configured to generate bubbles by mixing the liquid foaming agent with air, and to discharge the bubbles outward from the head block 100 (see FIG. 1). The liquid foaming agent is a mixture of the foaming agent and the liquid. An example of the liquid is water. An example of the foaming agent is soap or shampoo.

The bubble generator 120 is stored in the head housing 101 (see FIG. 3). The bubble generator 120 includes an agitating and mixing mechanism 130, a container 170 (see FIG. 6), and a fixed plate 180.

The container 170 stores the liquid foaming agent. The container 170 is, for example, made of a polyacetal resin. The container 170 is disposed inside the head housing 101 and is fixed to the head housing 101.

Figure 6:
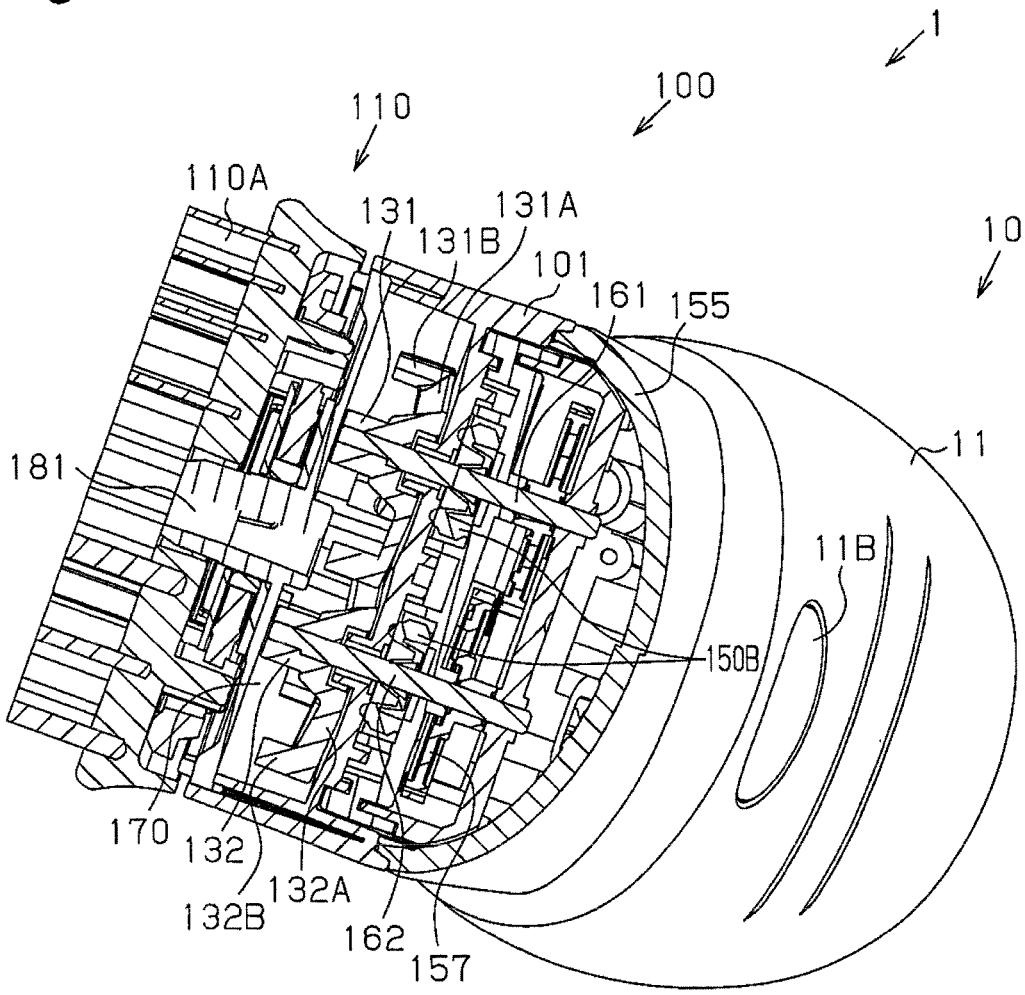
FIG. 6 is a cross-sectional view taken along a line Z6 to Z6 of FIG. 2.

As illustrated in FIGS. 6 and 7B, a discharge port 181 is formed in the container 170 and protrudes from the fixed plate 180. The discharge port 181 has, for example, a cylindrical shape. The discharge port 181 is open toward the brush unit 110. The discharge port 181 allows the internal space of the container 170 to communicate with the external space of the bubble generator 120. When the cosmetic device 1 is used, the liquid foaming agent is supplied to the container 170 via the discharge port 181. The bubble generator 120 generates the bubbles within the container 170. The bubbles are supplied to the brush unit 110 through the discharge port 181.

The agitating and mixing mechanism 130 is configured to generate the bubbles by mixing the liquid foaming agent with the air, while agitating the liquid foaming agent. As an example, the agitating and mixing mechanism 130 includes a first rotor 131, a second rotor 132, and a drive unit 140.

A structure of the drive unit 140 will be described referring to FIGS. 7A and 7B. The drive unit 140 drives the brush unit 110, the first rotor 131, and the second rotor 132, based on the driving force of the motor 13. As an example, the drive unit 140 includes a swinging plate 112, a plurality of gears 150A, a plurality of support shafts 160, and an eccentric cam 164. The plurality of support shafts 160 include a first support shaft 161, a second support shaft 162, and a third support shaft 163.

The brush unit 110 is an example of the cosmetic unit. The brush unit 110 serves to exert the cosmetic effect on the skin, by applying the soft physical stimulation to the skin. In this example, the brush unit 110 includes, for example, one brush 110A (see FIG. 1). The brush unit 110 is fixed to the swinging plate 112.

As illustrated in FIG. 7B, the swinging plate 112 is coupled to the fixed plate 180. The discharge port 181 is fitted to the hole at the center of the swinging plate 112. The swinging plate 112 is configured to swing in a circumferential direction about the discharge port 181 with respect to the fixed plate 180.

The plurality of gears 150A include a rotary drive gear 151, a spur gear 152, a crown gear 153, a rotation transmission gear 154, a first rotary gear 155, a rotation change gear 156, and a second rotary gear 157. The rotation transmission gear 154 includes two gears with different diameters, that is, a first rotation transmission gear 154A, and a second rotation transmission gear 154B.

The plurality of gears 150A are housed in a gear box 150 (see FIG. 3). For example, the gear box 150 is made of resin. A packing 150B (FIG. 3) is disposed between the gearbox 150 and the container 170. The packing 150B prevents the liquid foaming agent stored in the internal space of the container 170 from flowing into the interior of the gearbox 150.

The coupling 151A is coupled to the rotary drive gear 151. The coupling 151A protrudes from the head housing 101 via a hole of the head housing 101 (see FIG. 4). The coupling 151A may be fitted to the joint 14. By fitting the coupling 151A to the joint 14, the head block 100 is fixed to the main body block 10. In this state, the driving force of the motor 13 is transmitted to the rotary drive gear 151 via the joint 14 and the coupling 151A.

The rotary drive gear 151 is meshed with the spur gear 152. The spur gear 152 is meshed with the crown gear 153. The crown gear 153 is meshed with the first rotation transmission gear 154A. The first rotation transmission gear 154A and the second rotation transmission gear 154B are fixed to the third support shaft 163. The second rotation transmission gear 154B is meshed with the first rotary gear 155 and the rotation change gear 156. The rotation change gear 156 is meshed with the second rotary gear 157.

The first rotary gear 155 is coupled to the first support shaft 161. The first support shaft 161 is coupled to the first rotor 131. The first rotor 131 and the first support shaft 161 have the same axis. The second rotary gear 157 is coupled to the second support shaft 162. The second support shaft 162 is coupled to the second rotor 132. The second rotor 132 and the second support shaft 162 have the same axis.

The rotation of the rotary drive gear 151 is decelerated via the spur gear 152, the crown gear 153, the rotation transmission gear 154, and the first rotary gear 155. The rotation of the first rotary gear 155 is transmitted to the first rotor 131 via the first support shaft 161.

The rotation of the rotary drive gear 151 is decelerated via the spur gear 152, the crown gear 153, the rotation transmission gear 154, the rotation change gear 156, and the second rotary gear 157. The rotation of the second rotary gear 157 is transmitted to the second rotor 132 via the second support shaft 162.

Thus, the rotation of the rotary drive gear 151 is transmitted to the first rotor 131 and the second rotor 132. The first rotor 131 and the second rotor 132 rotate in the opposite directions to each other. Each of the reduction gear ratio between the rotary drive gear 151 and the first rotor 131 and the reduction gear ratio between the rotary drive gear 151 and the second rotor 132 is preferably included within the range of 1.6 to 6.4. For example, each of the reduction gear ratio is set to 3.2.

The rotational speed and the torque of the first rotor 131 may be adjusted by the reduction gear ratio between the rotary drive gear 151 and the first rotor 131. Similarly, the rotational speed and the torque of the second rotor 132 may be adjusted by the reduction gear ratio between the rotary drive gear 151 and the second rotor 132.

The rotation transmission gear 154 is coupled to the third support shaft 163. The third support shaft 163 is coupled to the eccentric cam 164. The eccentric cam 164 includes a convex portion 164A which is eccentric with respect to the rotational center axis of the third support shaft 163. The convex portion 164A is inserted into an elongated hole 114 of the swinging plate 112 through the fixed plate 180.

The third support shaft 163 and the eccentric cam 164 rotate along with the rotation of the rotation transmission gear 154. When the eccentric cam 164 rotates, the convex portion 164A reciprocates (eccentric motion) in the elongated hole 114 of the swinging plate 112 to swing the swinging plate 112 around the discharge port 181. The brush unit 110 is fixed to the swinging plate 112. Therefore, the brush unit 110 swings integrally with the swinging plate 112.

In this manner, the rotation of the rotary drive gear 151 is transmitted to the brush 110A. The reduction gear ratio between the rotary drive gear 151 and the eccentric cam 164 is preferably included within the range of 1.2 to 4.8. For example, this reduction gear ratio is set to 2.4. The reduction gear ratio between the rotary drive gear 151 and the eccentric cam 164 is substantially the same as the reduction gear ratio between the rotary drive gear 151 and the rotation transmission gear 154.

The structure of each rotor 131 and 132 will be described referring to FIGS. 8A and 8B. The first and second rotors 131 and 132 are disposed in the internal space of the container 170. Each of the rotors 131 and 132 is rotatably provided in the container 170. Each of the rotors 131 and 132 agitates the liquid foaming agent stored in the container 170.

A plurality of arms 131A are coupled to the first rotor 131. The arms 131A protrude outward in the radial direction from the outer periphery of the first rotor 131. The arms 131A are able to enhance the degree of agitating the liquid foaming agent and the air.

In other words, in the plan view of the first rotor 131, the arms 131A protrude generally radially from the rotational center axis of the first rotor 131. The basal end portion of each arm 131A coupled to the first rotor 131 has a constant interval from the basal end portion of the arm 131A that is adjacent in the circumferential direction. An interval between the basal end portions of the two adjacent arms 131A is substantially the same. Similarly, a plurality of arms 132A are coupled to the second rotor 132. The arms 132A have the same structures as those of the plurality of arms 131A.

A pillar 131B is coupled to the distal end portion of each arm 131A. The pillar 131B protrudes toward the axial direction of the first rotor 131 from the distal end portion of the corresponding arm 131A. When viewed in a plan view, that is, in the axial direction of the first rotor 131, the pillar 131B has a shape that tapers toward the rotational direction of the first rotor 131. The pillar 131B serves to enhance the degree of agitating the liquid foaming agent and the air. Similarly, the pillar 132B is coupled to the distal end portion of each arm 132A. The pillar 132B has a structure similar to that of the pillar 131B.

The structure of the fixed plate 180 will be described referring to FIGS. 8A and 8B. For example, the fixed plate 180 is made of a polyacetal resin. The fixed plate 180 is fitted to the head housing 101. The opening of the container 170 is covered with the fixed plate 180. A bearing 184 is disposed around the discharge port 181 at the position between the swinging plate 112 and the fixed plate 180. The bearing 184 is made of, for example, a metal.

The center of the discharge port 181 is located at a position which is offset from a line segment LX connecting the rotational center axis of the first rotor 131 and the rotational center axis of the second rotor 132 and at which the liquid foaming agent agitated by the first and second rotors 131 and 132 is converged. At this position, as compared to other positions of the container 170, the flow of the liquid foaming agent caused by the rotation of the first rotor 131 strongly interferes with the flow of the liquid foaming agent caused by the rotation of the second rotor 132. Thus, bubbles are easily generated as compared to other positions of the container 170.

The two suction ports 182 are formed in the fixed plate 180. The suction ports 182 pass through the fixed plate 180. The suction ports 182 allow the internal space of the container 170 to communicate with the external space of the bubble generator 120. The suction ports 182 serve as an air suction port that sucks air into the container 170.

The center of each suction port 182 is located at a position which is offset from the line segment LX and at which the liquid foaming agent agitated by the first and second rotors 131 and 132 is diffused. At this position, as compared to other positions of the container 170, the flow of the liquid foaming agent caused by the rotation of the first rotor 131 is hard to interfere with the flow of the liquid foaming agent caused by the rotation of the second rotor 132. Thus, the bubbles are hard to generate as compared to other positions of the container 170.

Each suction port 182 may also serve as a discharge port that discharges the excessive liquid foaming agent to the outside. When the liquid foaming agent exceeds a maximum storage amount of the container 170, the excessive liquid foaming agent is discharged to the outside through each suction port 182. The maximum storage amount is a storage amount that is suitable for generating a preferred amount of bubbles.

Figure 8A:
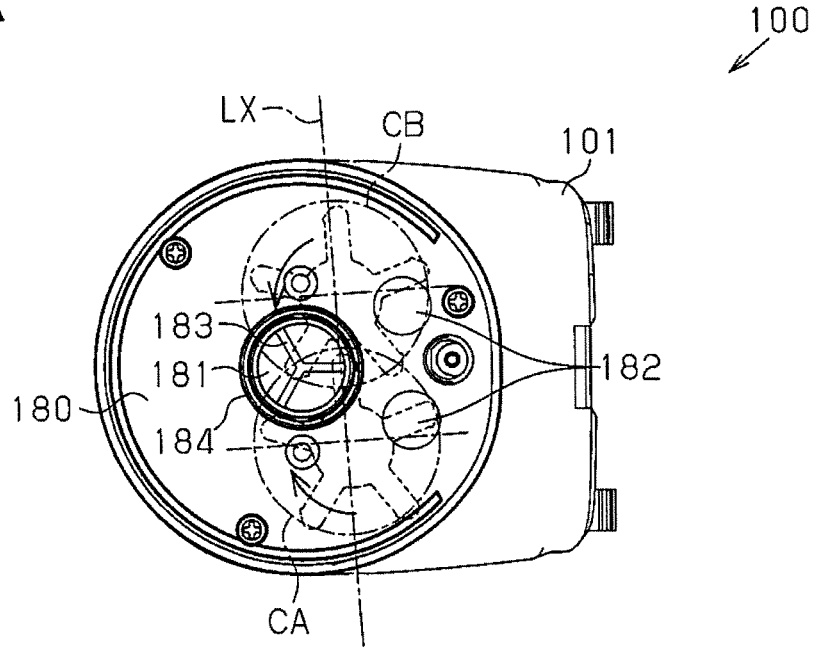
FIGS. 8A and 8B are schematic plan views of a head block in the first embodiment.
Figure 8B:
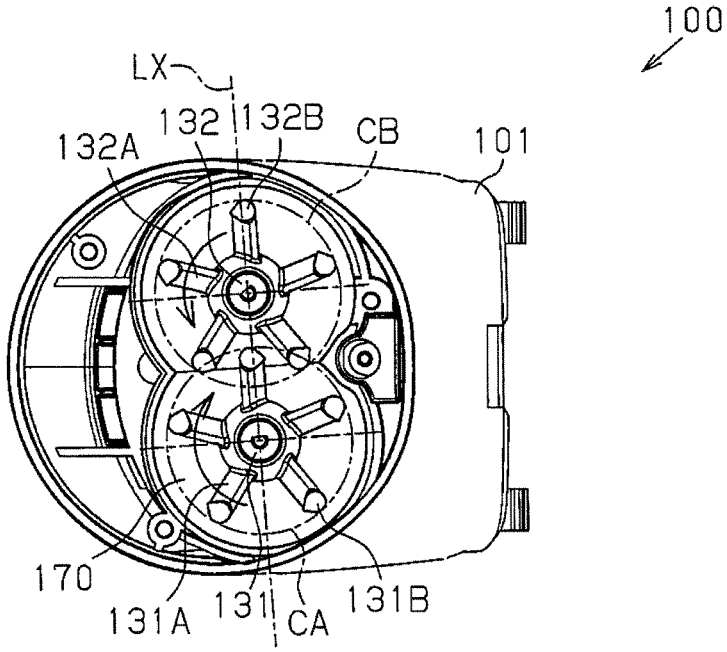

In FIGS. 8A and 8B, a virtual circle CA representatively illustrates one rotational orbit of the arm 131A. A virtual circle CB representatively illustrates one rotational orbit of the arm 132A. As illustrated by the virtual circles CA and CB, the rotational orbit of the arm 131A and the rotational orbit of the arm 132A partially overlap each other.

The pillar 131B coupled to the arm 131A faces an inner wall of the container 170 via the interval. The length of the interval is constant within a predetermined range of the first rotor 131 in the circumferential direction. Similarly, the pillar 132B coupled to the arm 132A faces the inner wall of the container 170 via the interval. The length of the interval is constant within a predetermined range of the second rotor 132 in the circumferential direction.

A plurality of crosspieces 183 are formed in the discharge port 181. The crosspieces 183 prevent the foreign objects or fingers from entering the container 170 from the outside of the discharge port 181. For example, the number of the cross-pieces 183 is three.

Figure 9:
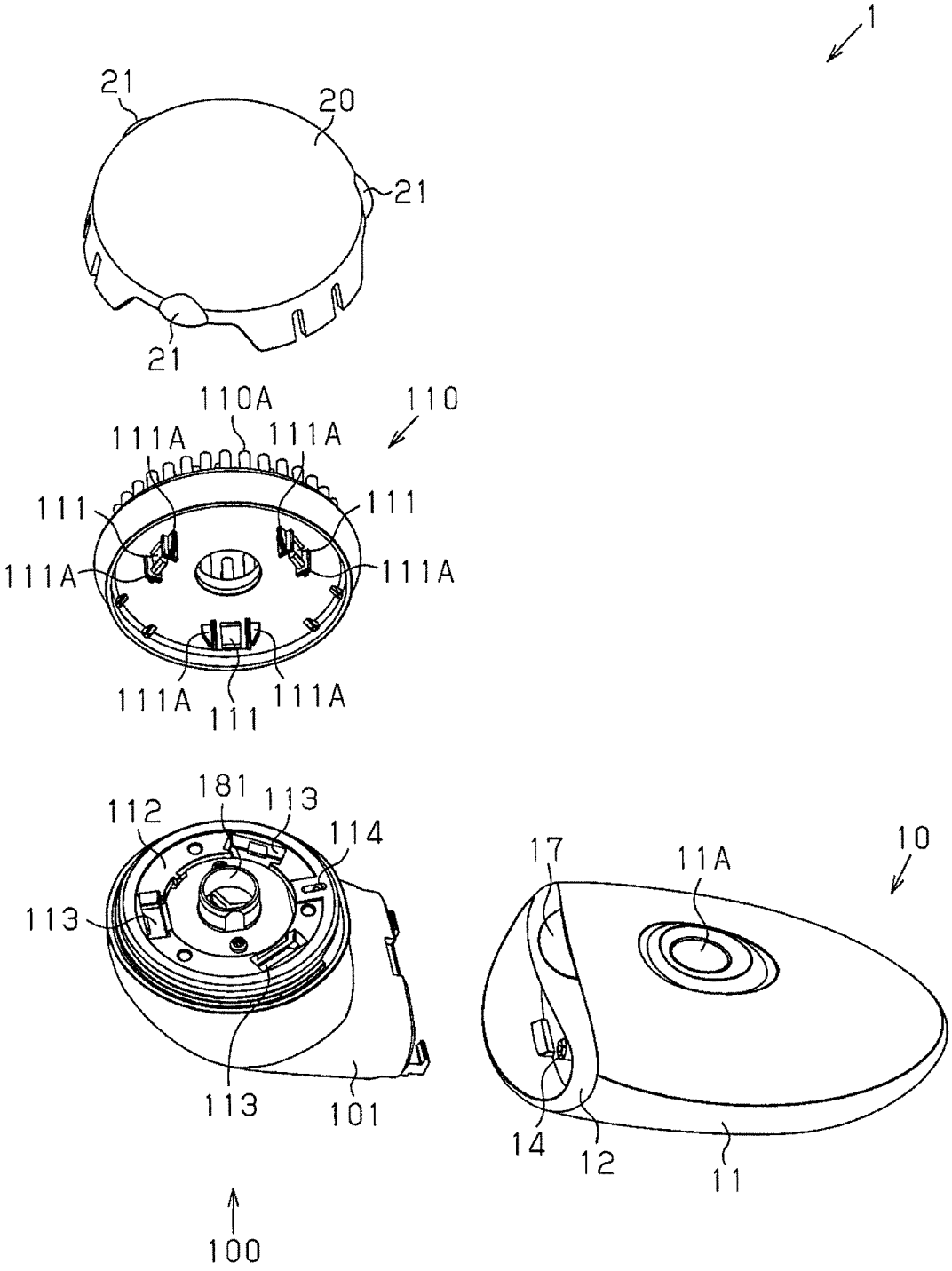
FIG. 9 is an exploded perspective view of the cosmetic device illustrated in FIG. 1.

FIG. 9 illustrates an exploded structure of the cosmetic device 1. Three hooks 111 are formed in the brush unit 110. Convex portions 111A are formed at both ends of each hook 111. The convex portions 111A reinforce the hook 111.

Three hook portions 113 are formed on the swinging plate 112. Each hook 111 is hooked to any one of the hook portions 113. Thus, the brush unit 110 and the swinging plate 112 are coupled to each other. The brush unit 110 and the swinging plate 112 can be separated from each other as needed.

Figure 10A:
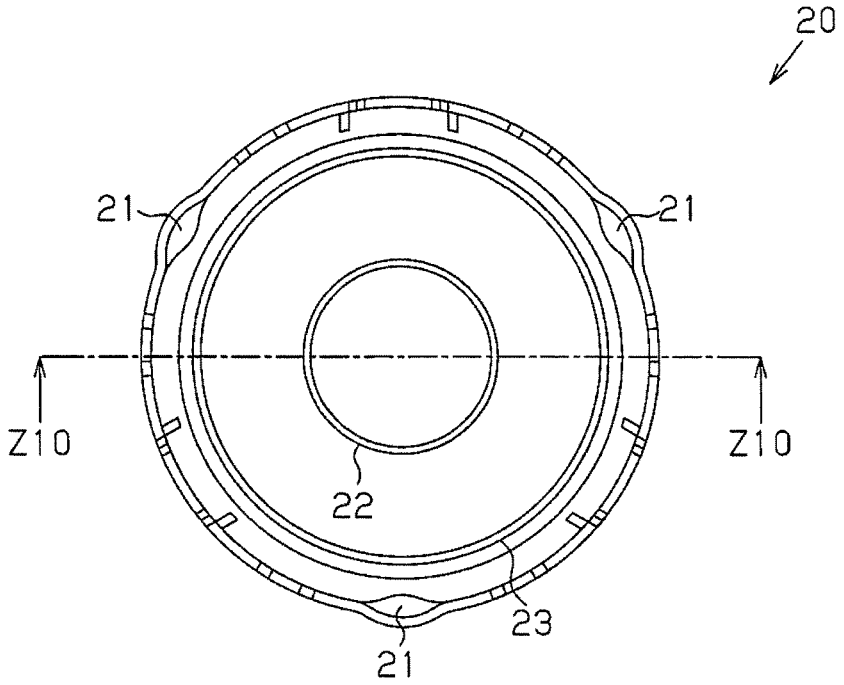
FIG. 10A is a front view of a cap illustrated in FIG. 9.
Figure 10B:
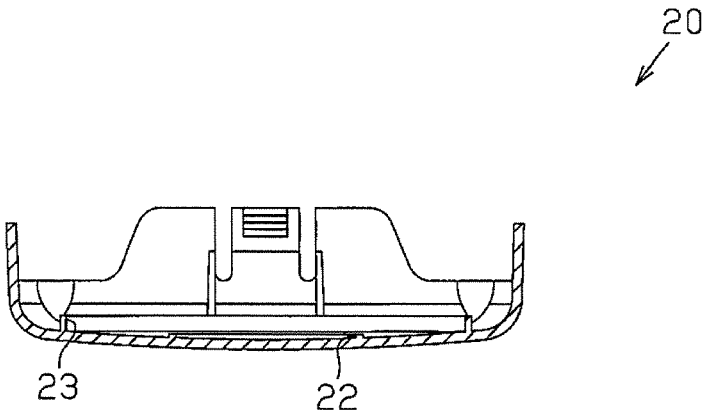
FIG. 10B is a cross-sectional view taken along a line Z10 to Z10 of FIG. 10A.

A structure of the head cap 20 will be described referring to FIGS. 10A and 10B. The head cap 20 is formed to be attachable and detachably to and from the brush unit 110. A spout 21, a foaming agent mark 22, and a water mark 23 are formed in the head cap 20. The spout 21 supplies the liquid foaming agent stored in the head cap 20 to the discharge port 181.

The foaming agent mark 22 is used to meter the foaming agent. The water mark 23 is used to meter the water. By mixing the foaming agent of an amount defined by the foaming agent mark 22 with water of an amount defined by the water mark 23, the unevenness of size of the bubbles is suppressed, and the liquid foaming agent suitable for generation of the fine bubbles is obtained.

An operation of the cosmetic device 1 will be described referring to FIGS. 3, 7A, 7B, 10, and 10B.

The cosmetic device 1 is used, for example, by the following procedure. First, the foaming agent and water are supplied to the head cap 20. Next, the liquid foaming agent is supplied to the container 170 from the head cap 20 via the discharge port 181. Next, the power switch 11A is turned on. Thus, the motor 13 is driven, and the light source 16 outputs the light.

Driving force of the motor 13 is transmitted to the plurality of gears 150A of the drive unit 140. As a result, the agitating and mixing mechanism 130 and the brush unit 110 are driven. More specifically, the first rotor 131 and the second rotor 132 rotate, and the brush unit 110 swings about the discharge port 181 in the circumferential direction.

When the first rotor 131 and the second rotor 132 rotate, the liquid foaming agent stored in the container 170 is mechanically agitated. Thus, to mix the liquid foaming agent and air is promoted, and the bubbles are generated. The bubbles are discharged to the outside of the brush unit 110 from the discharge port 181.

When the motor 13 is driven, the brush 110A coming in contact with the skin exerts the soft physical stimulation to the skin. At this time, since the bubbles supplied from the discharge port 181 has been supplied to the skin and the brush 110A, the cosmetic effect on the skin is further enhanced.

The cosmetic device 1 has the following advantages.

(1) The cosmetic device 1 has the agitating and mixing mechanism 130. Thus, the liquid foaming agent supplied to the container 170 is mechanically agitated to promote the mixing between the liquid foaming agent and air. Accordingly, even when the liquid and the foaming agent are not sufficiently mixed with each other, or even when the concentration of the foaming agent is high, it is possible to suppress the unevenness of the size of the bubbles to suitably generate the fine bubbles.

(2) The first rotor 131 and the second rotor 132 rotate in the opposite directions to each other. Thus, flow of the liquid foaming agent caused by the rotation of the first rotor 131 interferes with the flow of the liquid foaming agent caused by the rotation of the second rotor 132. Therefore, it is possible to generate the turbulent flow in the container 170, thereby to further promote the mixing between the liquid foaming agent and air. Accordingly, it is possible to enhance the effect of suppressing the unevenness of the size of the bubbles to generate the fine bubbles.

(3) The arms 131A protrude outward in the radial direction from the outer periphery of the rotor 131. Similarly, the arms 132A protrude outward in the radial direction from the outer periphery of the rotor 131. These arms 131A and 132A increase an area of the agitating portion coming into contact with the liquid foaming agent so as to increase the agitation capability. Accordingly, it is possible to further promote the mixing between the liquid foaming agent and air.

In addition, the peripheral speed of the distal end portion of the respective arms 131A and 132A is greater than the peripheral speed of the basal end portion of the respective arms 131A and 132A (that is, the surface of each of the rotors 131 and 132). Therefore, in the vicinity of the distal end portion of the arms 131A and 132A having the higher peripheral speed, that is, at a position away from the rotors 131 and 132, the agitation capability is enhanced. As a result, the mixing between the liquid foaming agent and air is further promoted. Accordingly, it is possible to enhance the effect of suppressing the unevenness of the size of the bubbles to generate the fine bubbles.

(4) The rotational orbit of the virtual circle CA partially overlaps the rotational orbit of the virtual circle CB. That is, the rotational orbit of each arm 131A protruding from the rotor 131 partially overlaps the rotational orbit of each arm 132A protruding from the rotor 132. As a result, in the vicinity of the position in which the two rotational orbits overlap each other, the flow of liquid caused by the rotation of the arm 131A interferes with the flow of the liquid caused by the rotation of the arm 132A. Therefore, it is possible to generate the turbulent flow in the container 170, thereby to further promote the mixing between the liquid foaming agent and air. Accordingly, it is possible to enhance the effect of suppressing the unevenness of the size of the bubbles to generate the fine bubbles.

(5) The pillar 131B protrudes toward the axial direction of the rotor 131 from the distal end portion of the arm 131A. Similarly, the pillar 132B protrudes toward the axial direction of the rotor 132 from the distal end portion of the arm 132A. The pillars 131B and 132B increase an area of the agitating member coming into contact with the liquid foaming agent to enhance the agitation capability. Thus, it is possible to further promote the mixing between the liquid foaming agent and air. Furthermore, in the vicinity of the distal end portion of the respective arms 131A and 132A having the higher peripheral speed, that is, at a position away from the respective rotors 131 and 132, the capability of agitating the liquid foaming agent is enhanced. Accordingly, it is possible to enhance the effect of suppressing the unevenness of the size of the bubbles to generate the fine bubbles.

(6) Each pillar 131B tapers toward the rotational direction of the rotor 131. Similarly, each pillar 132B tapers toward the rotational direction of the rotor 132. Therefore, each of the pillars 131B and 132B rotates to cut the liquid foaming agent. The inventors have confirmed that such an agitating mechanism promotes the mixing between the liquid foaming agent and air. It is believed that the turbulent flow is enhanced by the liquid foaming agent being agitated so as to be cut to each of the pillars 131B and 132B. Accordingly, it is possible to enhance the effect of suppressing the unevenness of the size of the bubbles to generate the fine bubbles.

(7) The center of the discharge port 181 is located at a position which is offset from the line segment LX and at which the liquid foaming agent agitated by the first and second rotors 131 and 132 is converged. At this position, the flow of the liquid foaming agent caused by the rotation of the first rotor 131 strongly interferes with the flow of the liquid foaming agent caused by the rotation of the second rotor 132. Thus, it is possible to efficiently generate the bubbles in the discharge port 181 compared to other positions. As a result, the bubbles generated by agitating the liquid foaming agent are gathered to the discharge port 181 and are continuously discharged from the discharge port 181.

(8) The center of the suction port 182 is located at a position which is offset from the line segment LX and at which the liquid foaming agent agitated by the first and second rotors 131 and 132 is diffused. At this position, as compared to the position at which the center of the discharge port 181 is located, the flow of the liquid foaming agent caused by the rotation of the first rotor 131 is hard to interfere with the flow of the liquid foaming agent caused by the rotation of the second rotor 132. Therefore, the bubbles are relatively hard to be generated in the suction port 182. In addition, the bubbles are hard to reach the suction port 182. This reduces the concern that the flow of air passing through the suction port 182 is blocked by the bubble, and air mixed with the liquid foaming agent is insufficient. Accordingly, it is possible to enhance the effect of suppressing the unevenness of the size of the bubbles to generate the fine bubbles.

(9) The head cap 20 can be attached to the brush unit 110. Thus, it is possible to suppress the deformation of the brush 110A when storing or carrying the cosmetic device 1.

(10) The head cap 20 has a foaming agent mark 22 and a water mark 23. By injecting a foaming agent and water into the container 170 according to the marks 22 and 23, it is possible to suppress the unevenness of dimension of the bubbles, and to easily generate the liquid foaming agent at the foaming agent concentration that is suitable for generation of the fine bubbles. Furthermore, the head cap 20 may be used as a measuring cup. Thus, there is no need to separately prepare the measuring cup.

(11) The brush unit 110, the first rotor 131, and the second rotor 132 are driven by a single motor 13. Thus, it is possible to easily miniaturize the cosmetic device 1, compared to a structure in which a plurality of motors are mounted.

(12) The head block 100 has an attachment structure that is attachable and detachable to and from the main body block 10. Thus, it is possible to replace the brush unit 110 with the different types of cosmetic units.

(13) The brush unit 110 can be separated from the swinging plate 112. Thus, the cleaning of the brush unit 110 is easy. Also, when the brush 110A is consumed, it is possible to replace only the brush unit 110 with a new brush unit.

Second Embodiment

Figure 11:
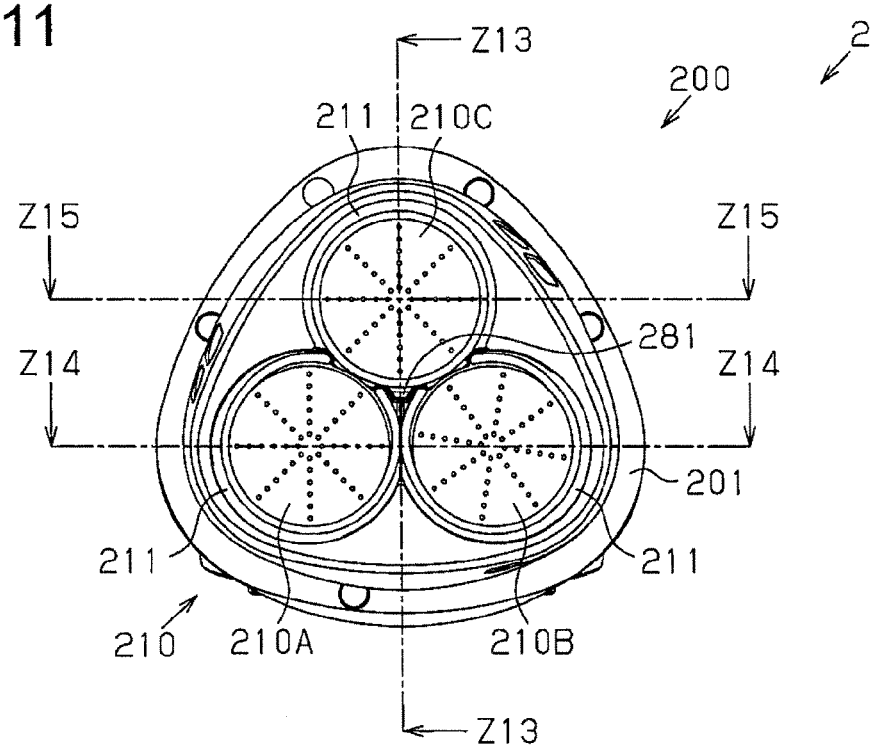
FIG. 11 is a front view of a head block in a second embodiment.
Figure 12:
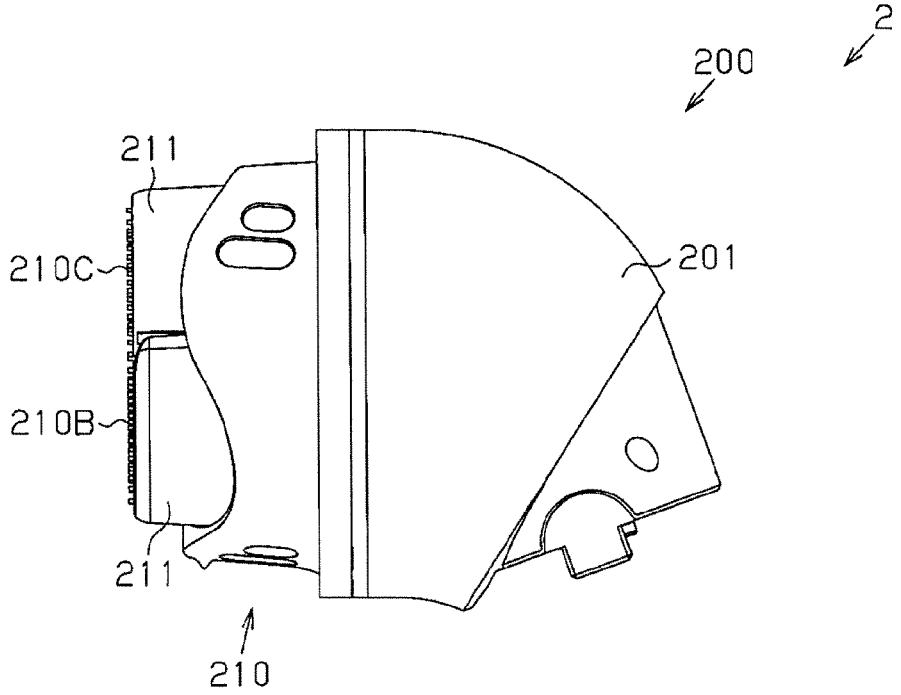
FIG. 12 is a right side view of the head block illustrated in FIG. 11.

An external structure of a cosmetic device 2 of a second embodiment will be described referring to FIGS. 11 and 12. In the cosmetic device 1 of the first embodiment, the head block 100 including one brush 110A was provided. Meanwhile, in the cosmetic device 2 of the second embodiment, a head block 200 including three brushes is provided in place of the head block 100.

An internal structure of the head block 200 will be described referring to FIGS. 13 to 15. For example, the head block 200 includes a head housing 201, a brush unit 210, and a bubble generator 220 (see FIGS. 16A to 16C).

The brush unit 210 is an example of the cosmetic unit. The brush unit 210 serves to exert a cosmetic effect on the skin by applying the soft physical stimulation to the skin. In this example, the brush unit 210 includes a first brush 210A, a second brush 210B, a third brush 210C, three cylinders 211, three first elastic elements 212, (see FIG. 15, only two are illustrated in FIG. 15), and an elastic element group 270.

Figure 13:
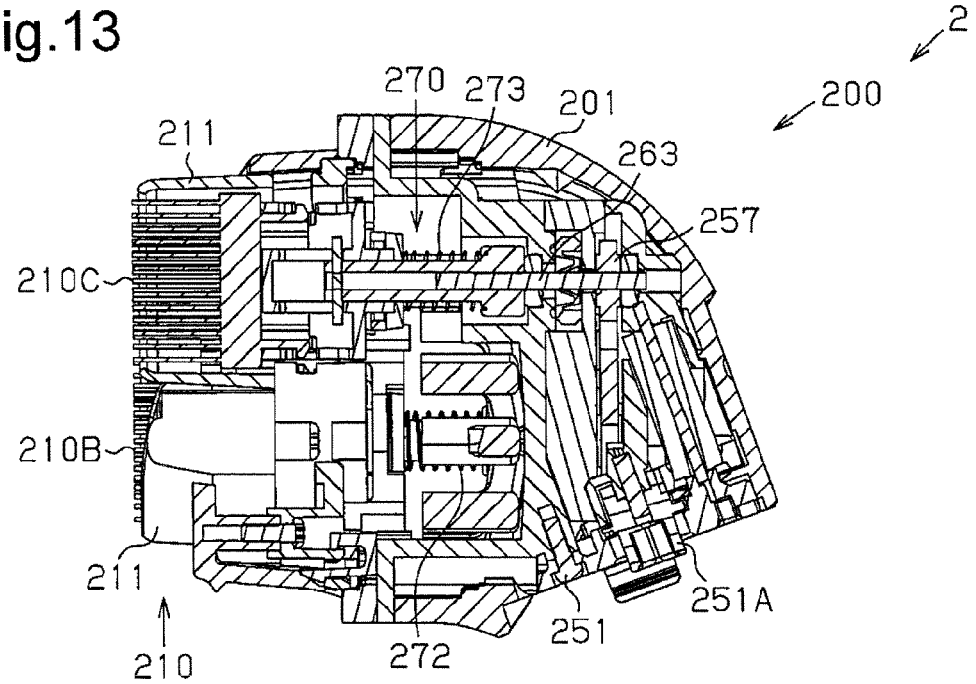
FIG. 13 is a cross-sectional view taken along a line Z13 to Z13 of FIG. 11.
Figure 14:
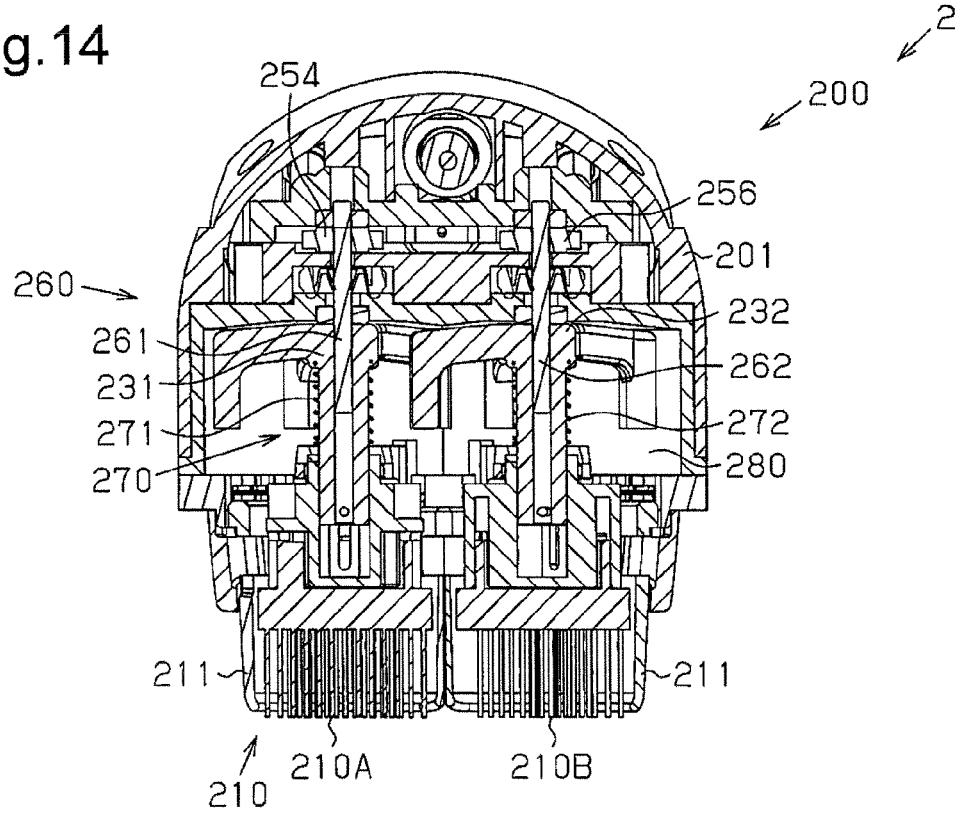
FIG. 14 is a cross-sectional view taken along a line Z14 to Z14 of FIG. 11.

As illustrated in FIG. 14, the elastic element group 270 includes a second elastic element 271, a third elastic element 272, and a fourth elastic element 273 (see FIG. 13). The second elastic element 271 is disposed between the first brush 210A and the first rotary gear 254. The third elastic element 272 is disposed between the second brush 210B and the second rotary gear 256. The fourth elastic element 273 is disposed between the third brush 210C (see FIG. 13) and the third rotary gear 257 (see FIG. 13). The first to third brushes 210A to 210C are provided to be able to float within a range of a predetermined distance in an axial direction of the brush with respect to the head housing 201, by each of the second to fourth elastic elements 271 to 273.

Figure 15:
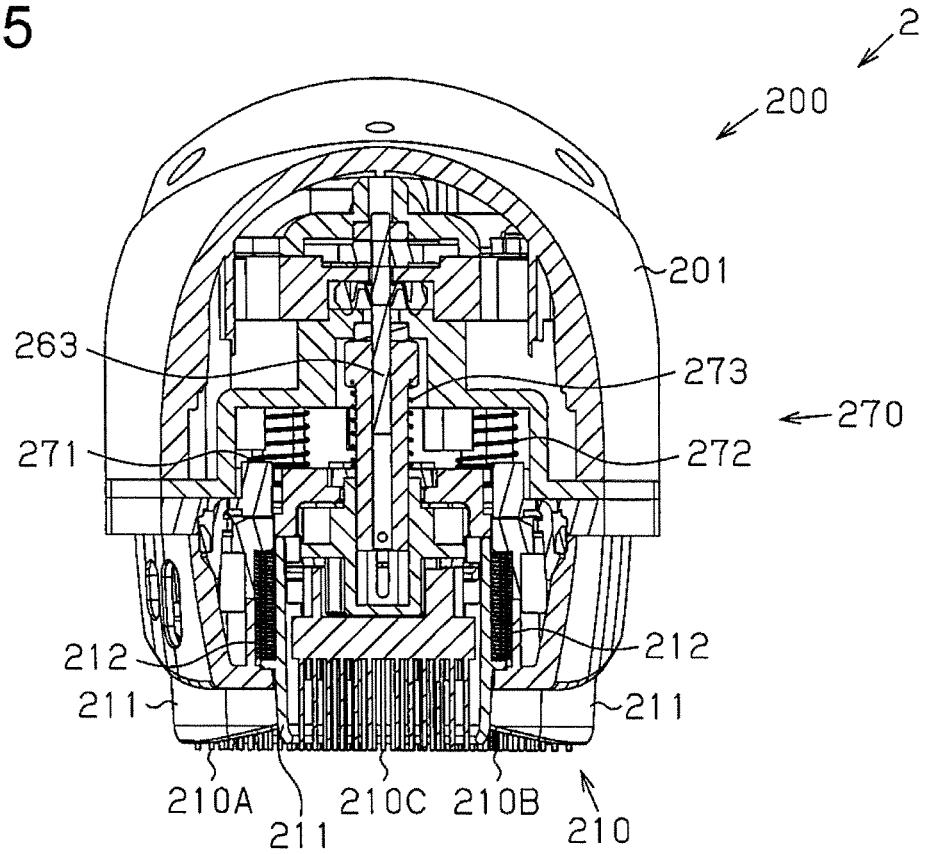
FIG. 15 is a cross-sectional view taken along a line Z15 to Z15 of FIG. 11.

As illustrated in FIG. 15, the three cylinders 211 are supported by the head housing 201. Each cylinder 211 protrudes toward the axial direction of the brush from the leading end side of the head housing 201. Each of the brushes 210A to 210C is disposed inside the corresponding cylinder 211. Each of the three first elastic elements 212 is disposed among the three cylinders 211 and the head housing 201. Each cylinder 211 is provided to be able to float within a range of a predetermined distance in the axial direction with respect to the brush head housing 201, by the corresponding first elastic element 212. That is, each cylinder 211 is provided to be able to float within the range of the predetermined distance in the axial direction of the brush, independently from each of the brushes 210A to 210C.

Figure 16A:
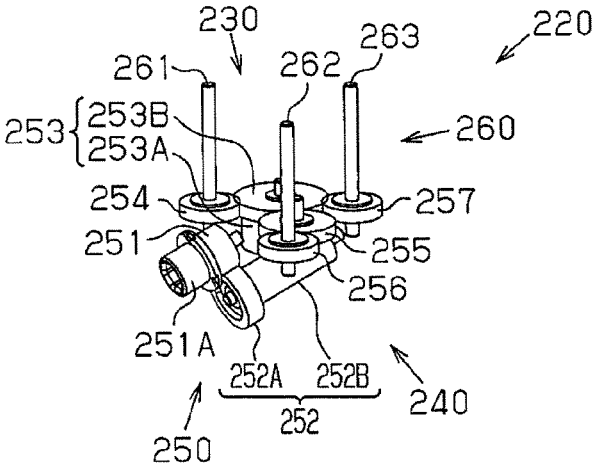
FIGS. 16A to 16C are schematic perspective views of a drive unit according to a second embodiment.
Figure 16B:
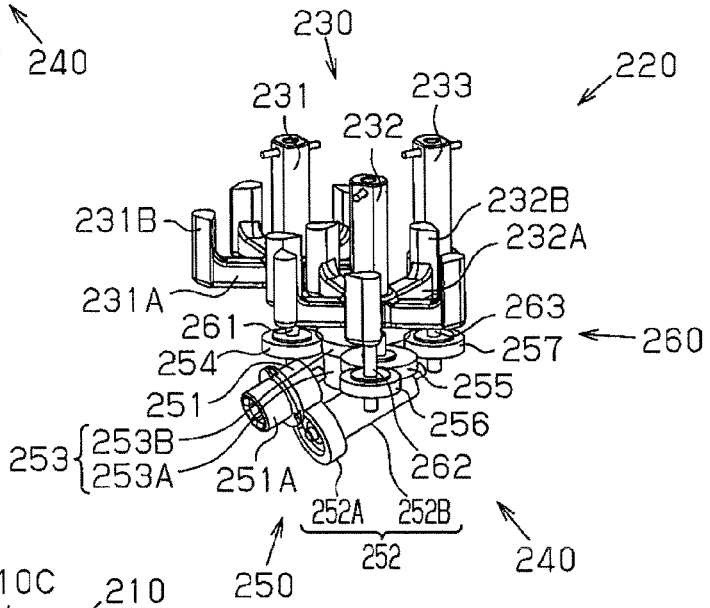
Figure 16C:
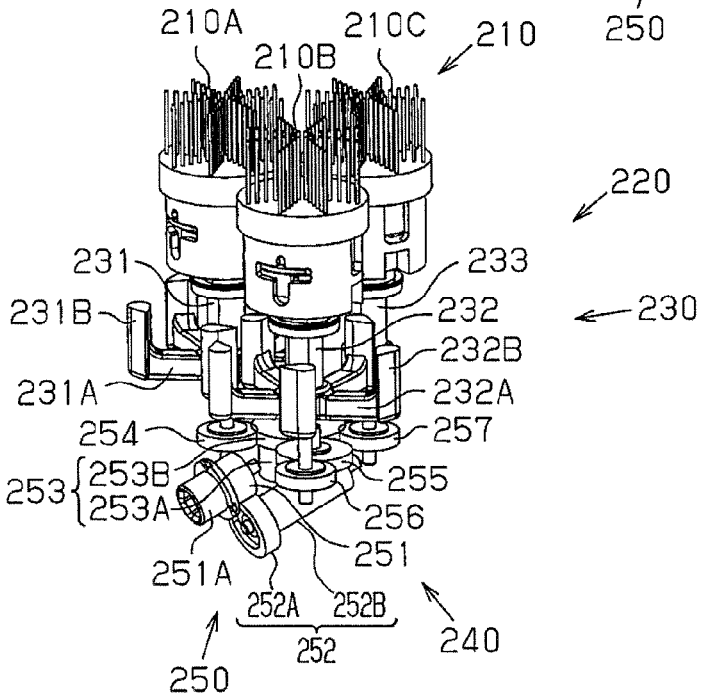

FIGS. 16A to 16C illustrate a bubble generator 220. The bubble generator 220 is housed within the head housing 201 (see FIG. 14). The bubble generator 220 includes an agitating and mixing mechanism 230 and a container 280 (see FIG. 14). The container 280 is disposed in the head housing 201 and is fixed to the head housing 201.

A discharge port 281 (see FIG. 11) is formed in the container 280. The discharge port 281 is open toward the brush unit 210 (see FIG. 11). The bubbles generated in the container 280 are supplied to the brush unit 210 via the discharge port 281.

The agitating and mixing mechanism 230 includes a first rotor 231, a second rotor 232, and a drive unit 240. As in the first embodiment, the first and second rotors 231 and 232 are disposed within the container 280. Each of the rotors 231 and 232 is rotatably provided in the container 280.

A structure of the drive unit 240 will be described referring to FIGS. 16A to 16C. The drive unit 240 includes a plurality of gears 250, a plurality of support shafts 260, and elastic element group 270 (see FIG. 13). The plurality of gears 250 include a rotary drive gear 251, a combination gear 252, a rotation transmission gear 253, a first rotary gear 254, a rotation change gear 255, a second rotary gear 256, and a third rotary gear 257. The combination gear 252 includes two gears with different types, that is, a first combination gear 252A and a second combination gear 252B. The rotation transmission gear 253 includes two gears having different diameters, that is, a first rotation transmission gear 253A and a second rotation transmission gear 253B. The support shafts 260 include a first support shaft 261, a second support shaft 262, and a third support shaft 263.

A coupling 251A is coupled to the rotary drive gear 251. The coupling 251A protrudes from the head housing 201 via a hole of the head housing 201 (see FIG. 14). The coupling 251A can be fitted to the joint 14 (see FIG. 9). By fitting the coupling 251A to the joint 14, the head block 200 is fixed to the main body block 10 (see FIG. 9). In this state, the driving force of the motor 13 is transmitted to the rotary drive gear 251 via the joint 14 and the coupling 251A.

The rotary drive gear 251 is meshed with the first combination gear 252A. The first combination gear 252A and the second combination gear 252B have the same axis. The second combination gear 252B is meshed with the first rotation transmission gear 253A. The first rotation transmission gear 253A and the second rotation transmission gear 253B have the same axis. The second rotation transmission gear 253B is meshed with the first rotary gear 254, the rotation change gear 255, and the third rotary gear 257. The rotation change gear 255 is meshed with the second rotary gear 256.

The first rotary gear 254 is coupled to the first support shaft 261. The first support shaft 261 is coupled to the first rotor 231. The first rotor 231 is coupled to the first brush 210A. The first rotor 231, the first support shaft 261, and the first brush 210A have the same axis.

The second rotary gear 256 is coupled to the second support shaft 262. The second support shaft 262 is coupled to the second rotor 232. The second rotor 232 is coupled to the second brush 210B. The second rotor 232, the second support shaft 262, and the second brush 210B have the same axis.

The third rotary gear 257 is coupled to the third support shaft 263. The third support shaft 263 is coupled to the third rotor 233. The third rotor 233 is coupled to the third brush 210C. The third rotor 233, the third support shaft 263, and the third brush 210C have the same axis.

Rotation of the rotary drive gear 251 is decelerated via the combination gear 252, the rotation transmission gear 253, and the first rotary gear 254. Rotation of the first rotary gear 254 is transmitted to the first rotor 231 via the first support shaft 261. Thus, the first brush 210A rotates together with the first rotor 231.

Furthermore, the rotation of the rotary drive gear 251 is decelerated via the combination gear 252, the rotation transmission gear 253, the rotation change gear 255, and the second rotary gear 256. Rotation of the second rotary gear 256 is transmitted to the second rotor 232 via the second support shaft 262. Thus, the second brush 210B rotates together with the second rotor 232.

Furthermore, the rotation of the rotary drive gear 251 is decelerated via the combination gear 252, the rotation transmission gear 253, and the third rotary gear 257. The rotation of the third rotary gear 257 is transmitted to the third rotor 233 via the third support shaft 263. Thus, the third brush 210C rotates together with the third rotor 233.

In this manner, the rotation of the rotary drive gear 251 is transmitted to the first to third brushes 210A to 210C. A reduction gear ratio between the rotary drive gear 251 and the first brush 210A, a reduction gear ratio between the rotary drive gear 251 and the second brush 210B, and a reduction gear ratio between the rotary drive gear 251 and the third brush 210C are preferably included within the range of 1.6 to 6.4. For example, the reduction gear ratios are set to 3.2. The rotational speed and the torque of the first brush 210A may be adjusted depending on the reduction gear ratio between the rotary drive gear 251 and the first rotary gear 254. The rotational speed and the torque of the second brush 210B may be adjusted depending on the reduction gear ratio between the rotary drive gear 251 and the second rotary gear 256. The rotational speed and the torque of the third brush 210C may be adjusted depending on the reduction gear ratio between the rotary drive gear 251 and the third rotary gear 257.

The first rotor 231 and second rotor 232 rotate in the opposite directions to each other. That is, the first brush 210A and the second brush 210B rotate in the opposite directions to each other. In addition, the second brush 210B rotates in the direction opposite to the first and third brushes 210A and 210C.

The arms 231A are coupled to the first rotor 231. Similarly, the arms 232A are connected to the second rotor 232. Furthermore, the pillar 231B is coupled to the distal end portion of the arm 231A. Similarly, the pillar 232B is coupled to the distal end portion of the arm 232A. The arms 231A and 232A and the pillars 231B and 232B have the same structures as those of the arms 131A and 132A and the pillars 131B and 132B in the first embodiment.

An operation of the cosmetic device 2 will be described referring to FIG. 15. When the motor 13 is driven, the driving force of the motor 13 is transmitted to the plurality of gears 250 of the drive unit 240. As a result, the agitating and mixing mechanism 230 and the brush unit 210 are driven. Specifically, the first to third rotors 231 to 233 rotate, and the first to third brushes 210A to 210C rotate.

The liquid foaming agent stored in the container 280 is mechanically agitated by rotation of the first and second rotors 231 and 232. Thus, the liquid foaming agent and air are mixed with each other to generate the bubbles. The bubbles are discharged to the outside of the brush unit 210 from the discharge port 281.

When the motor 13 is driven, the brushes 210A to 210C being in contact with the skin imparts the soft physical stimulation to the skin. At this time, since the bubbles supplied from the discharge port 281 are supplied to the skin and the brushes 210A to 210C, the cosmetic effect on the skin may be further enhanced.

In addition to the advantage according to (1) to (12) obtained by the cosmetic device 1 of the first embodiment, the cosmetic device 2 of the second embodiment has the following advantages.

(14) The brushes 210A to 210C and the three cylinders 211 can float independently from one another in the axial direction of the brush with respect to the head housing 201. Thus, by allowing the respective brushes 210A to 210C and the respective cylinder 211 to float in accordance with the irregularities of the skin, each of the brushes 210A to 210C may be softly brought into contact with the skin. Further, it is easy to bring each of the brushes 210A to 210C into close contact with the skin. Accordingly, the cosmetic effect is promoted.

(15) The second brush 210B rotates in the direction opposite to the first and third brushes 210A and 210C. Thus, the force acting on the skin from the each of the brushes 210A to 210C is dispersed. Therefore, it is possible to advantageously suppress the skin from being caught between the brushes 210A to 210C, together with the rotation of the brush unit 210. Furthermore, when moving the brush unit 210 while being in contact with the skin, resistance to the brush unit 210 is reduced. Accordingly, it is easy to move the brush unit 210 along the skin.

(16) Each of the brushes 210A to 210C is disposed in the different cylinders 211. Thus, the bubbles are easily accumulated in the cylinder 211 of each of the brushes 210A to 210C. Accordingly, it is possible to exert the soft physical stimulation to the skin. In addition, since the cylinder 211 that does not rotate is also subjected to the force pressed against the skin from the brush unit 210 during rotation, it is possible to suppress a situation in which the skin is caught due to the rotation of the brush unit 210, and the positions of the skin and the brush unit 210 are shifted. Consequently, it is easy to move the brush unit 210 along the skin.

Third Embodiment

Figure 17:
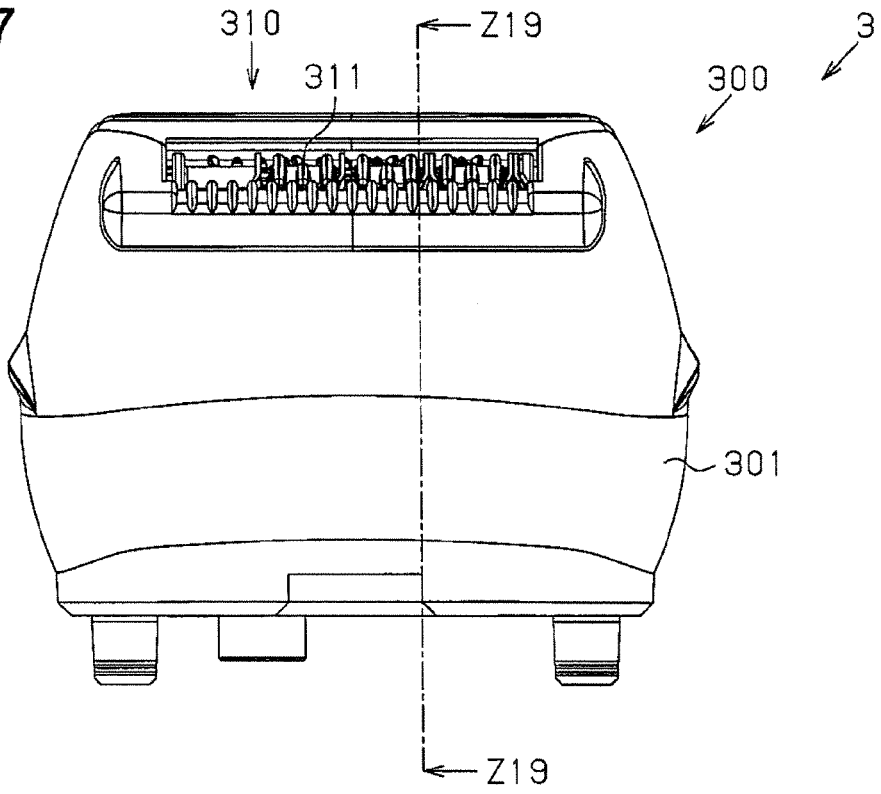
FIG. 17 is a front view of a head block according to a third embodiment.
Figure 18:
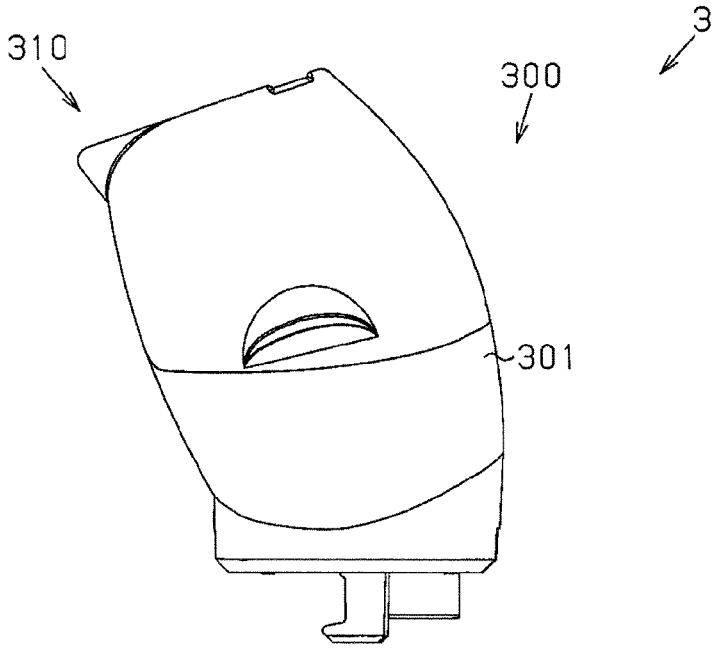
FIG. 18 is a right side view of the head block illustrated in FIG. 17.

An external structure of a cosmetic device 3 according to a third embodiment will be described referring to FIGS. 17 and 18. In the above-described cosmetic device 1 of the first embodiment, the head block 100 including the one brush 110A was provided. Meanwhile, in the cosmetic device 3 according to the third embodiment, a head block 300 including a hair depilation mechanism is provided in place of the head block 100.

Figure 19:
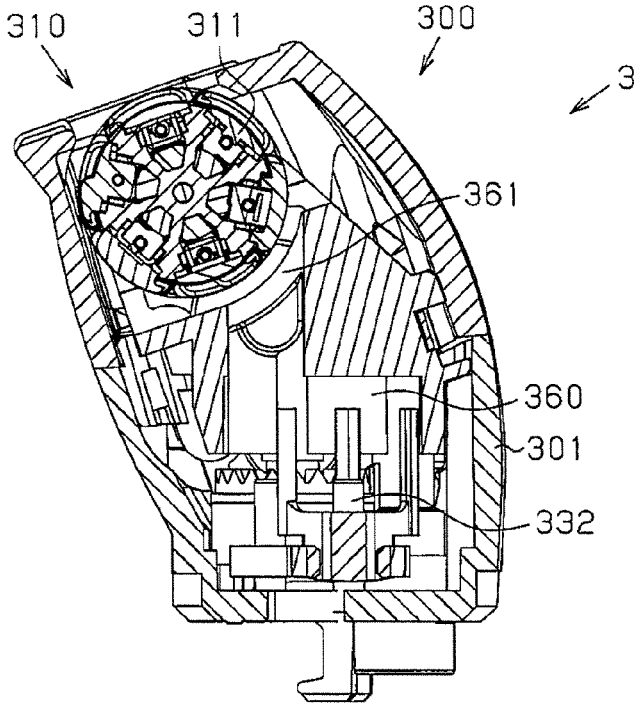
FIG. 19 is a cross-sectional view taken along a line Z19 to Z19 of FIG. 17.

An internal structure of the head block 300 will be described referring to FIG. 19. For example, the head block 300 includes a head housing 301, a hair depilation unit 310, and a bubble generator 320 (see FIG. 20).

The hair depilation unit 310 is an example of a cosmetic unit. The hair depilation unit 310 serves to exert a cosmetic effect on the skin, by pulling out the hair from the skin. The hair depilation unit 310 has a shape of a drum. Opening and closing claws 311 are formed on an outer periphery of the hair depilation unit 310. A unit gear 310A (see FIG. 20) is formed on a side part of the hair depilation unit 310. When the hair depilation unit 310 rotates, the opening and closing claws 311 are open and closed to interpose the hair therebetween. The hair interposed between the opening and closing claws 311 are pulled out of the skin, based on the rotation of the hair depilation unit 310.

Figure 20:
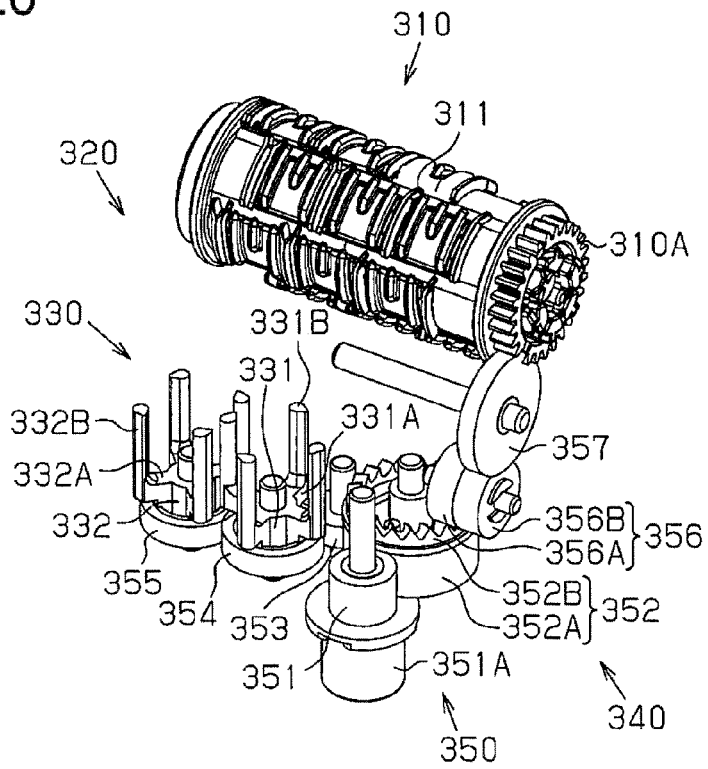
FIG. 20 is a perspective view illustrating a hair depilation unit of a drive unit according to the third embodiment.

FIG. 20 illustrates a bubble generator 320. The bubble generator 320 is stored inside the head housing 301 (see FIG. 19). The bubble generator 320 includes an agitating and mixing mechanism 330, and a container 360 (see FIG. 19). The container 360 is disposed inside the head housing 301 and is fixed to the head housing 301.

A discharge port 361 (see FIG. 19) is formed in the container 360. The discharge port 361 is open toward the hair depilation unit 310 (see FIG. 19). The bubbles generated in the container 360 are supplied to the hair depilation unit 310 via the discharge port 361.

The agitating and mixing mechanism 330 includes a first rotor 331, a second rotor 332, and a drive unit 340. The first and second rotors 331 and 332 are disposed in the container 360. Each of the rotors 331 and 332 is rotatably provided within the container 360.

A structure of the drive unit 340 will be described referring to FIG. 20. The drive unit 340 includes a plurality of gears 350. The plurality of gears 350 include a rotary drive gear 351, a combination gear 352, a rotation transmission gear 353, a first rotary gear 354, a second rotary gear 355, a rotation input gear 356, and a rotation output gear 357. The combination gear 352 includes two gears having different types, that is, a first combination gear 352A and a second combination gear 352B are included. The rotation input gear 356 includes two gears having different shapes, that is, a first rotation input gear 356A and a second rotation input gear 356B are included.

A coupling 351A is coupled to the rotary drive gear 351. The coupling 351A protrudes from the head housing 301 via a hole of the head housing 301 (see FIG. 19). The coupling 351A can be fitted to the joint 14 (see FIG. 9). By fitting the coupling 351A to the joint 14, the head block 300 is fixed to the main body block 10 (see FIG. 9). In this state, the driving force of the motor 13 is transmitted to the rotary drive gear 351 via the joint 14 and the coupling 351A.

The rotary drive gear 351 is meshed with the first combination gear 352A. The first combination gear 352A is meshed with the rotation transmission gear 353. The first combination gear 352A and the second combination gear 352B have the same axis. The rotation transmission gear 353 is meshed with the first rotary gear 354. The first rotary gear 354 is meshed with the second rotary gear 355. The second combination gear 352B is meshed with the first rotation input gear 356A. The first rotation input gear 356A and the second rotation input gear 356B have the same axis. The second rotation input gear 356B is meshed with the rotation output gear 357. The rotation output gear 357 is meshed with the unit gear 310A. The first rotary gear 354 and the first rotor 331 have the same axis. The second rotary gear 355 and the second rotor 332 have the same axis.

The rotation of the rotary drive gear 351 is decelerated via the combination gear 352, the rotation transmission gear 353, and the first rotary gear 354. The rotation of the first rotary gear 354 is transmitted to the first rotor 331.

In addition, the rotation of the rotary drive gear 351 is decelerated via the combination gear 352, the rotation transmission gear 353, the first rotary gear 354, and the second rotary gear 355. The rotation of the second rotary gear 355 is transmitted to the second rotor 332.

In this manner, the rotation of the rotary drive gear 351 is transmitted to the first and second rotors 331 and 332. The first rotor 331 and the second rotor 332 rotate in the opposite directions to each other. The reduction gear ratio between the rotary drive gear 351 and the first rotor 331, and the reduction gear ratio between the rotary drive gear 351 and the second rotor 332 are preferably included within the range of 0.8 to 3.2. For example, the reduction gear ratios are set to 1.6.

The rotational speed and the torque of the first rotor 331 may be adjusted depending on the reduction gear ratio between the rotary drive gear 351 and the first rotor 331. Furthermore, the rotational speed and the torque of the second rotor 332 may be adjusted depending on the reduction gear ratio between the rotary drive gear 351 and the second rotor 332.

The rotation of the rotary drive gear 351 is decelerated via the combination gear 352, the rotation input gear 356, the rotation output gear 357, and the unit gear 310A. When the rotation of the rotary drive gear 351 is transmitted to the unit gear 310A, the hair depilation unit 310 rotates.

The reduction gear ratio between the rotary drive gear 351 and the hair depilation unit 310 is preferably within the range of 1.6 to 6.6. For example, the reduction gear ratio is set to 3.3. In addition, the reduction gear ratio between the rotary drive gear 351 and the hair depilation unit 310 is substantially the same as the reduction gear ratio between the rotary drive gear 351 and the unit gear 310A.

It is preferred that the rotational speed of the first and second rotors 331 and 332 be higher than the rotational speed of the hair depilation unit 310. However, the rotational speed of the first and second rotors 331 and 332 may be the same as the rotational speed of the hair depilation unit 310, or may be lower than the rotational speed of the hair depilation unit 310.

The arms 331A are coupled to the first rotor 331. Similarly, the arms 332A are coupled to the second rotor 332. Furthermore, the pillar 331B is coupled to the distal end portion of the arm 331A. Similarly, the pillar 332B is coupled to the distal end portion of the arm 332A. The arms 331A and 332A and the pillars 331B and 332B have the same structures as those of the arms 131A and 132A and the pillars 131B and 132B in the first embodiment.

An operation of the cosmetic device 3 will be described referring to FIG. 19. When the motor 13 is driven, the driving force of the motor 13 is transmitted to the plurality of the gears 350 of the drive unit 340. As a result, the agitating and mixing mechanism 330 and the hair depilation unit 310 are driven. Specifically, the first and second rotors 331 and 332 rotate, and the hair depilation unit 310 rotates.

By rotation of the first and second rotors 331 and 332, the liquid foaming agent stored in the container 360 is mechanically agitated. Thus, the liquid foaming agent and air are mixed with each other to generate the bubbles. The bubbles are discharged to the outside of the hair depilation unit 310 from the discharge port 361.

When the hair depilation unit 310 rotates, the opening and closing claws 311 are open and closed. When the opening and closing claws 311 are open, the hair enters between the claws. When the opening and closing claws 311 are closed, the hair is interposed by the claws. Therefore, by bringing the hair depilation unit 310 into contact with the skin, the hair is pulled out of the skin. At this time, since the bubbles supplied from the discharge port 361 are supplied to the skin and the hair depilation unit 310, the cosmetic effect on the skin may be further enhanced. The cosmetic device 3 according to the third embodiment has the advantages according to (1) to (12) obtained by the cosmetic device 1 of the first embodiment.

Fourth Embodiment

Figure 21:
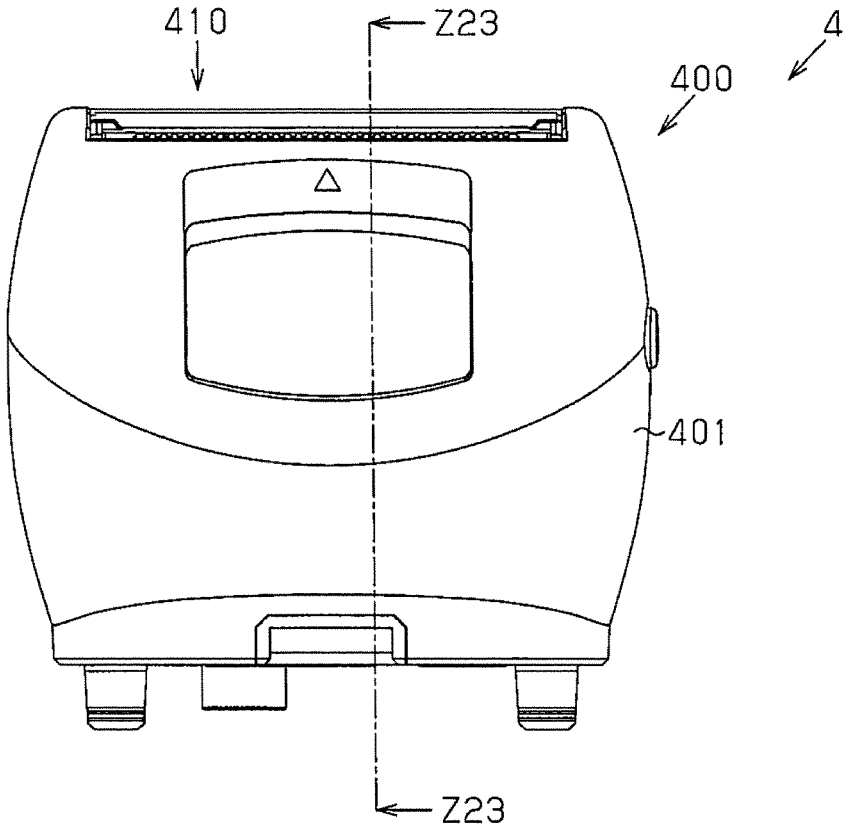
FIG. 21 is a front view of a head block in a fourth embodiment.
Figure 22:
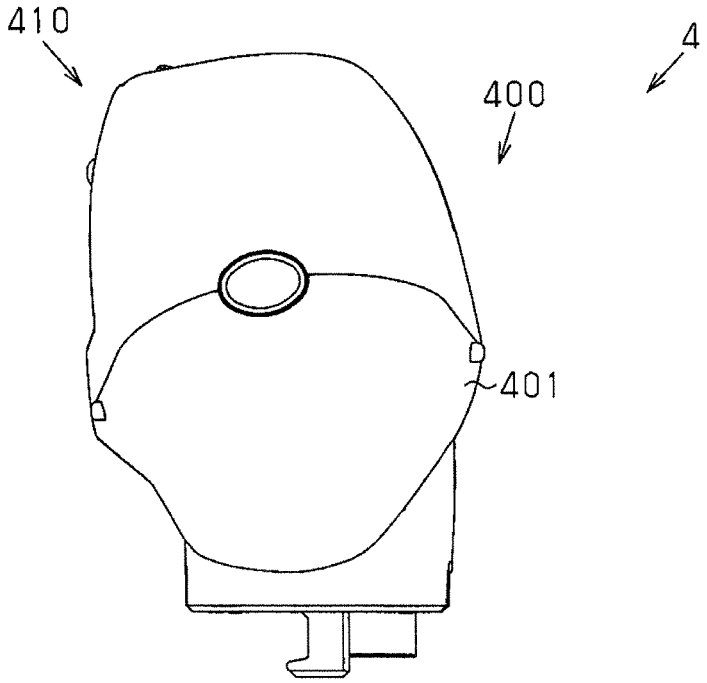
FIG. 22 is a right side view of the head block illustrated in FIG. 21.

An external structure of a cosmetic device 4 according to a fourth embodiment will be described referring to FIGS. 21 and 22. In the cosmetic device 1 of the first embodiment, the head block 100 including the one brush 110A was provided. Meanwhile, in the cosmetic device 4 of the fourth embodiment, a head block 400 including a hair removal mechanism is provided in place of the head block 100.

Figure 23:
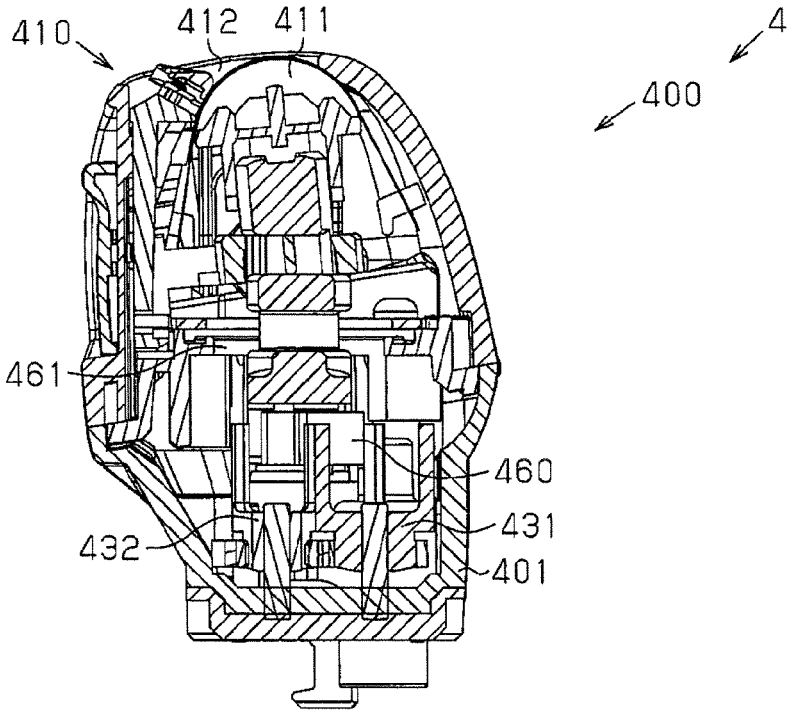
FIG. 23 is a cross-sectional view taken along a line Z23 to Z23 of FIG. 21.

An internal structure of the head block 400 will be described referring to FIG. 23. For example, the head block 400 includes a head housing 401, a hair removal unit 410, and a bubble generator 420 (see FIG. 24).

The hair removal unit 410 is an example of the cosmetic unit. The hair removal unit 410 serves to exert a cosmetic effect on the skin, by cutting the hair from the skin. In this example, the hair removal unit 410 includes an inner blade 411 and an outer blade 412. The inner blade 411 swings with respect to the outer blade 412. The hair removal unit 410 cuts the hair by contact of each of the inner blade 411 and the outer blade 412.

Figure 24:
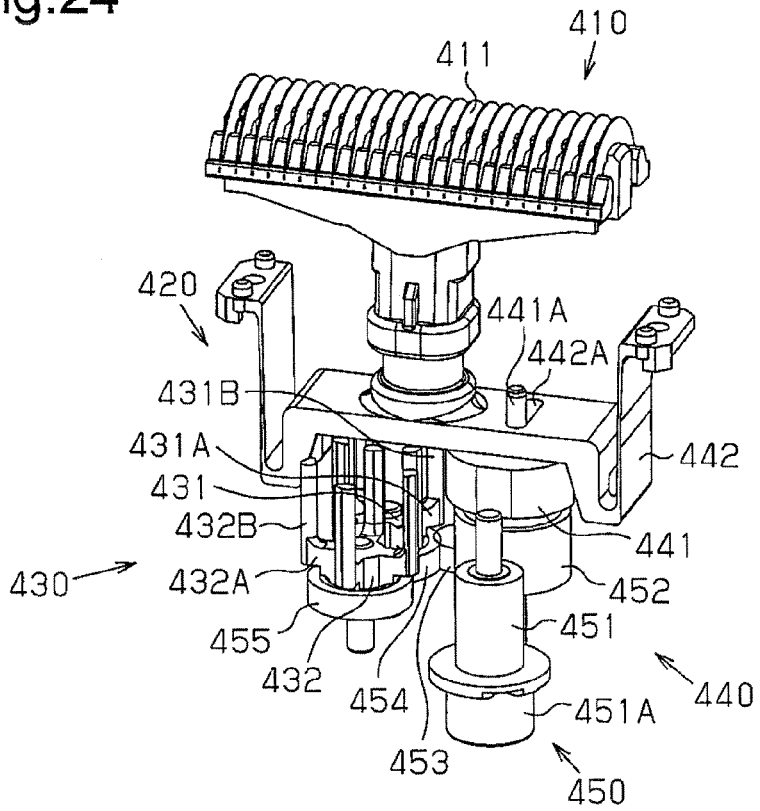
FIG. 24 is a perspective view illustrating a hair removal unit of the drive unit in a fourth embodiment.

FIG. 24 illustrates a bubble generator 420. The bubble generator 420 is housed inside the head housing 401 (see FIG. 23). The bubble generator 420 includes an agitating and mixing mechanism 430, and a container 460 (see FIG. 23). The container 460 is disposed inside the head housing 401 and is fixed to the head housing 401.

A discharge port 461 (see FIG. 23) is formed in the container 460. The discharge port 461 is open toward the hair removal unit 410 (see FIG. 23). The bubbles generated in the container 460 are supplied to the hair removal unit 410 via the discharge port 461.

The agitating and mixing mechanism 430 includes a first rotor 431, a second rotor 432, and a drive unit 440. The first and second rotors 431 and 432 are disposed within the container 460. Each of the rotors 431 and 432 is rotatably provided within the container 460.

A structure of the drive unit 440 will be described referring to FIG. 24. The drive unit 440 includes an eccentric cam 441, a driving element 442, and a plurality of gears 450. The gears 450 include a rotary drive gear 451, a connecting gear 452, a rotation transmission gear 453, a first rotary gear 454, and a second rotary gear 455.

A coupling 451A is coupled to the rotary drive gear 451. The coupling 451A protrudes from the head housing 401 via a hole of the head housing 401 (see FIG. 23). The coupling 451A can be fitted to the joint 14 (see FIG. 9). By fitting the coupling 451A to the joint 14, the head block 400 is fixed to the main body block 10 (see FIG. 9). In this state, the driving force of the motor 13 is transmitted to the rotary drive gear 451 via the joint 14 and the coupling 451A.

The rotary drive gear 451 is meshed with the connecting gear 452. The connecting gear 452 is meshed with the rotation transmission gear 453. The rotation transmission gear 453 is meshed with the first rotary gear 454. The first rotary gear 454 is meshed with the second rotary gear 455. The first rotary gear 454 and the first rotor 431 have the same axis. The second rotary gear 455 and the second rotor 432 have the same axis.

Rotation of the rotary drive gear 451 is decelerated via the connecting gear 452, the rotation transmission gear 453, and the first rotary gear 454. Rotation of the first rotary gear 454 is transmitted to the first rotor 431.

Further, the rotation of the rotary drive gear 451 is decelerated via the connecting gear 452, the rotation transmission gear 453, the first rotary gear 454, and the second rotary gear 455. Rotation of the second rotary gear 455 is transmitted to the second rotor 432.

In this manner, the rotation of the rotary drive gear 451 is transmitted to the first and second rotors 431 and 432. The first rotor 431 and the second rotor 432 rotate in the opposite directions to each other. The reduction gear ratio between the rotary drive gear 451 and the first rotor 431, and the reduction gear ratio between the rotary drive gear 451 and the second rotor 432 are preferably included within the range of 0.6 to 2.6. For example, the reduction gear ratios are set to 1.3.

The rotational speed and the torque of the first rotor 431 may be adjusted depending on the reduction gear ratio between the rotary drive gear 451 and the first rotor 431. Furthermore, the rotational speed and the torque of the second rotor 432 may be adjusted depending on the reduction gear ratio between the rotary drive gear 451 and the second rotor 432.

The connecting gear 452 and the eccentric cam 441 are fixed to the same axis. The eccentric cam 441 includes a convex portion 441A which is eccentric with respect to the rotational center axis of the connecting gear 452. The convex portion 441A is inserted into an elongated hole 442A formed on the driving element 442. An inner blade 411 as a part of the hair removal unit 410 is mounted to the driving element 442.

The rotation of the rotary drive gear 451 is transmitted to the connecting gear 452. The rotation of the connecting gear 452 is transmitted to the eccentric cam 441. When the eccentric cam 441 rotates, the convex portion 441A laterally swings the driving element 442, by reciprocating (eccentrically moving) within the elongated hole 442A of the driving element 442. Therefore, the inner blade 411 attached to the driving element 442 swings with respect to the outer blade 412, integrally with the driving element 442.

In this manner, the rotation of the rotary drive gear 451 is transmitted to the inner blade 411. The reduction gear ratio between the rotary drive gear 451 and the eccentric cam 441 is preferably within the range of 0.9 to 3.8. For example, the reduction gear ratio is set to 1.9. The reduction gear ratio between the rotary drive gear 451 and the eccentric cam 441 is substantially the same as the reduction gear ratio between the rotary drive gear 451 and the connecting gear 452.

The arms 431A are coupled to the first rotor 431. Similarly, the arms 432A are coupled to the second rotor 432. Furthermore, the pillar 431B is coupled to the distal end portion of the arm 431A. Similarly, the pillar 432B is coupled to the distal end portion of the arm 432A. The arms 431A and 432A and the pillars 431B and 432B have the same structures as those of the arms 131A and 132A and the pillars 131B and 132B in the first embodiment.

An operation of the cosmetic device 4 will be described referring to FIG. 23. When the motor 13 is driven, the driving force of the motor 13 is transmitted to the plurality of gears 450 of the drive unit 440. As a result, the agitating and mixing mechanism 430 and the hair removal unit 410 are driven. Specifically, the first and second rotors 431 and 432 rotate, and the inner blade 411 of the hair removal unit 410 laterally swings with respect to the outer blade 412.

By the rotation of the first and second rotors 431 and 432, the liquid foaming agent stored in the container 460 is mechanically agitated. Thus, the liquid foaming agent and air are mixed with each other to generate bubbles. The bubbles are discharged to the outside of the hair removal unit 410 from the discharge port 461.

By bringing the hair removal unit 410 into contact with the skin, the hair is cut by cooperation between the inner blade 411 and the outer blade 412. At this time, since the bubbles supplied from the discharge port 461 are supplied to the skin and the hair removal unit 410, the cosmetic effect on the skin may be further enhanced. The cosmetic device 4 of the fourth embodiment has the advantages according to (1) to (12) obtained by the cosmetic device 1 of the first embodiment.

Fifth Embodiment

Figure 25:
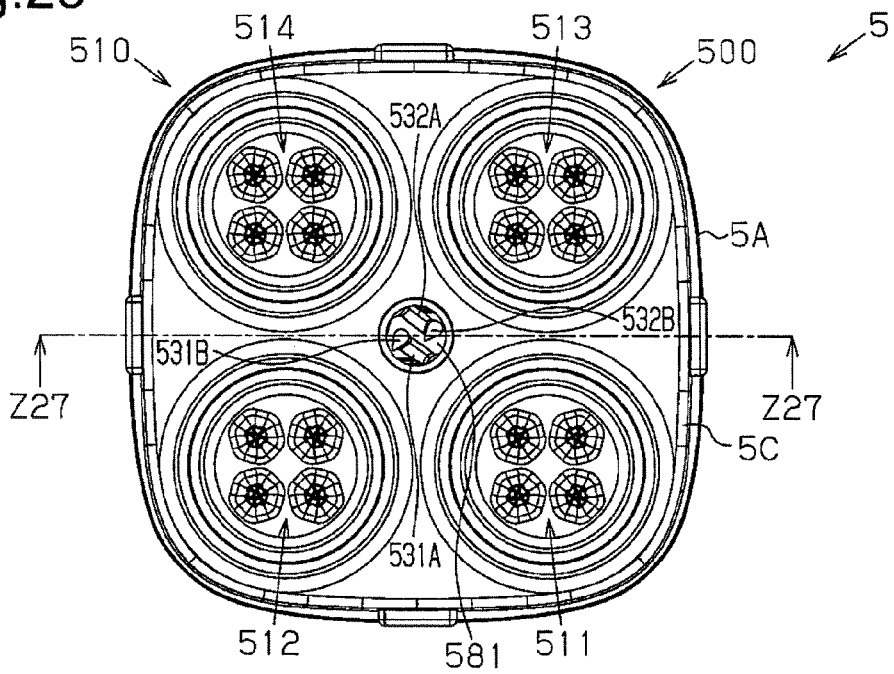
FIG. 25 is a plan view of a cosmetic device according to a fifth embodiment.
Figure 26:
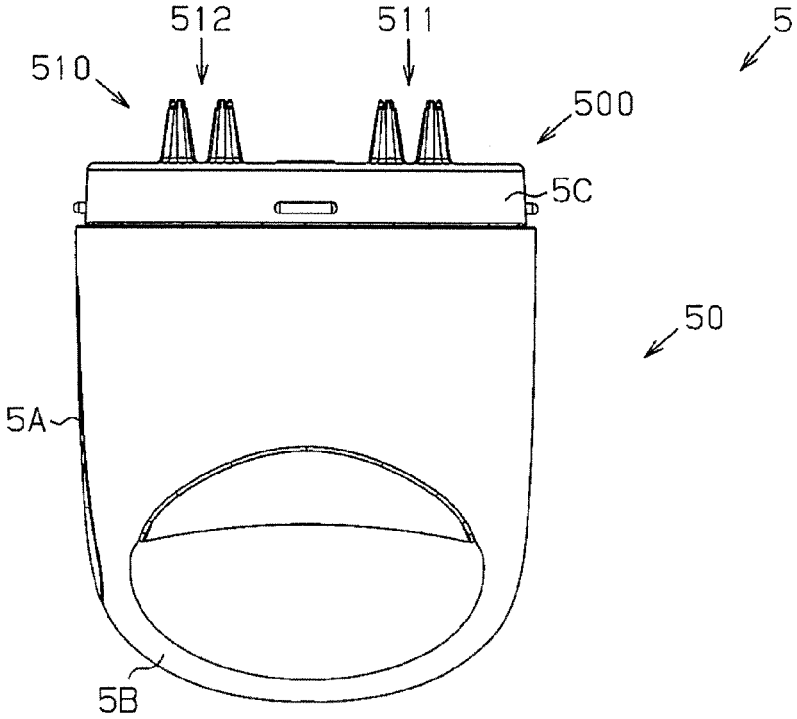
FIG. 26 is a front view of the cosmetic device illustrated in FIG. 25.

An external structure of a cosmetic device 5 according to a fifth embodiment will be described referring to FIGS. 25 and 26. In the cosmetic device 1 of the first embodiment, the head block 100 including the one brush 110A was provided. Meanwhile, in the cosmetic device 5 according to the fifth embodiment, a head block 500 including a massage function of a scalp is provided.

Figure 27:
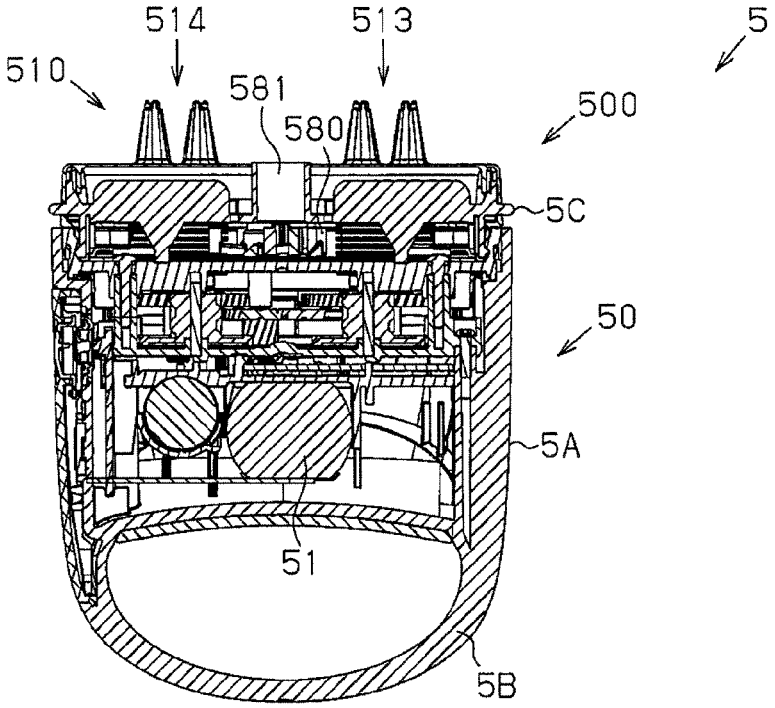
FIG. 27 is a cross-sectional view taken along a line Z27 to Z27 of FIG. 25.

An internal structure of the cosmetic device 5 will be described referring to FIG. 27. The cosmetic device 5 includes a main body block 50, a head block 500, a housing 5A, and a head cover 5C. The head block 500 is assembled integrally with the main body block 50. The housing 5A includes a handle 5B. The main body block 50 includes a motor 51. The motor 51 is housed within the housing 5A.

Figure 28:
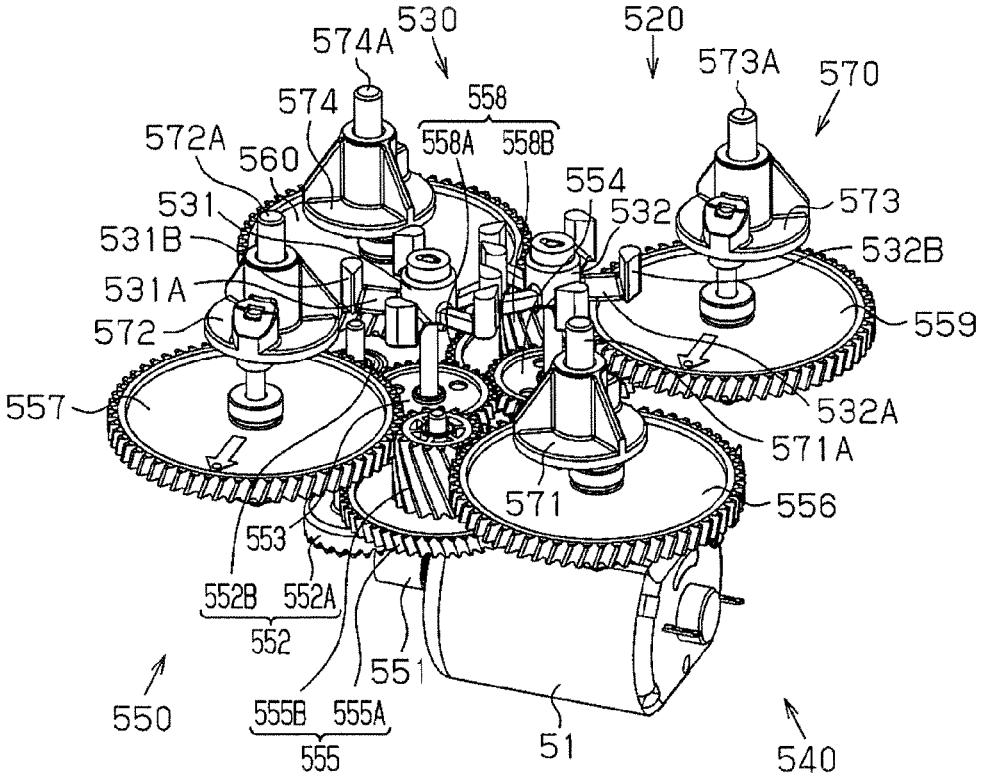
FIG. 28 is a perspective view of the drive unit in the fifth embodiment.

The head block 500 includes a head cover 5C, a massaging unit 510, and a bubble generator 520 (see FIG. 28). The head cover 5C is fitted to the opening portion of the housing 5A.

The massaging unit 510 is an example of the cosmetic unit. The massaging unit 510 serves to exert the cosmetic action on the skin by applying the soft physical stimulation to the scalp. As illustrated in FIG. 25, the massaging unit 510 includes a first massaging element unit 511, a second massaging element unit 512, a third massaging element unit 513, and a fourth massaging element unit 514. Each of the massaging element units 511 to 514 includes, for example, four massaging elements. Each of the massaging elements is made of, for example, a rubber material, and has a shape that is suitable for massaging the scalp.

FIG. 28 illustrates a bubble generator 520. The bubble generator 520 is housed within the housing 5A (see FIG. 27). The bubble generator 520 includes an agitating and mixing mechanism 530, and a container 580 (see FIG. 27). The container 580 is disposed within the housing 5A and is fixed to the housing 5A.

A discharge port 581 (see FIG. 27) is formed in the container 580. The discharge port 581 is open toward the massaging unit 510. Bubbles generated in the container 580 are supplied to the massaging unit 510 via the discharge port 581.

The agitating and mixing mechanism 530 includes a first rotor 531, a second rotor 532, and a drive unit 540. The first and second rotors 531 and 532 are disposed within the container 580. Each of the rotors 531 and 532 is rotatably provided within the container 580.

A structure of the drive unit 540 will be described referring to FIG. 28. The drive unit 540 includes a plurality of gears 550, and a plurality of eccentric cams 570. The gears 550 include a rotary drive gear 551, a combination gear 552, a first rotary gear 553, and a first accessory gear (not illustrated). Furthermore, the gears 550 include a second rotary gear 554, a second accessory gear (not illustrated), a rotation transmission gear 555, a first massaging gear 556, a second massaging gear 557, a rotation transmission gear 558, a third massaging gear 559, and a fourth massaging gear 560. The eccentric cams 570 include a first eccentric cam 571, a second eccentric cam 572, a third eccentric cam 573, and a fourth eccentric cam 574.

The rotary drive gear 551 is fixed to an output shaft of the motor 51, for example, by press-fitting. Thus, the driving force of the motor 51 is transmitted to the rotary drive gear 551. The combination gear 552 includes two gears having the different types, that is, a first combination gear 552A and a second combination gear 552B. The rotation transmission gear 555 includes two gears having the different diameters, that is, a first rotation transmission gear 555A and a second rotation transmission gear 555B. The rotation transmission gear 558 includes two gears having the different diameters, that is, a first rotation transmission gear 558A and a second rotation transmission gear 558B.

The rotary drive gear 551 is meshed with the first combination gear 552A. The first combination gear 552A and the second combination gear 552B have the same axis. The second combination gear 552B is meshed with the first rotary gear 553. The first rotary gear 553 is engaged with the second rotary gear 554. The first rotary gear 553 and the first accessory gear have the same axis. The first accessory gear is meshed with the first rotation transmission gear 555A. The first rotation transmission gear 555A and the second rotation transmission gear 555B have the same axis. The second rotation transmission gear 555B is meshed with the first massaging gear 556 and the second massaging gear 557.

The second rotary gear 554 and the second accessory gear have the same axis. The second accessory gear is meshed with the first rotation transmission gear 558A. The first rotation transmission gear 558A and the second rotation transmission gear 558B have the same axis. The second rotation transmission gear 558B is meshed with the third massaging gear 559 and the fourth massaging gear 560. The first rotary gear 553 and the first rotor 531 have the same axis. The second rotary gear 554 and the second rotor 532 have the same axis.

Rotation of the rotary drive gear 551 is decelerated via the combination gear 552 and the first rotary gear 553. Rotation of the first rotary gear 553 is transmitted to the first rotor 531.

Further, the rotation of the drive gear 551 is decelerated via the combination gear 552, the first rotary gear 553, and the second rotary gear 554. The rotation of the second rotary gear 554 is transmitted to the second rotor 532.

In this manner, the rotation of the drive gear 551 is transmitted to the first and second rotors 531 and 532. The first rotor 531 and the second rotor 532 rotate in the opposite directions to each other. The reduction gear ratio between the rotary drive gear 551 and the first rotor 531, and the reduction gear ratio between the rotary drive gear 551 and the second rotor 532 are preferably included within the range of 2.4 to 9.8. For example, the reduction gear ratios are set to 4.9.

The rotational speed and torque of the first rotor 531 may be adjusted depending on the reduction gear ratio between the rotary drive gear 551 and the first rotor 531. Furthermore, the rotational speed and the torque of the second rotor 532 may be adjusted depending on the reduction gear ratio between the rotary drive gear 551 and the second rotor 532.

The first massaging gear 556 and the first eccentric cam 571 are fixed to the same axis. An output shaft 571A of the first eccentric cam 571 is eccentric with respect to the rotational center axis of the first massaging gear 556. Therefore, the output shaft 571A revolves with respect to the rotational center axis of the first massaging gear 556. A bottom surface of the first massaging element unit 511 is fixed to the output shaft 571A.

The second massaging gear 557 and the second eccentric cam 572 are fixed to the same axis. An output shaft 572A of the second eccentric cam 572 is eccentric with respect to the rotational center axis of the second massaging gear 557. Therefore, the output shaft 572A revolves with respect to the rotational center axis of the second massaging gear 557. A bottom surface of the second massaging element unit 512 is fixed to the output shaft 572A.

The third massaging gear 559 and the third eccentric cam 573 are fixed to the same axis. An output shaft 573A of the third eccentric cam 573 is eccentric with respect to the rotational center axis of the third massaging gear 559. Therefore, the output shaft 573A revolves with respect to the rotational center axis of the third massaging gear 559. A bottom surface of the third massaging element unit 513 is fixed to the output shaft 573A.

The fourth massaging gear 560 and the fourth eccentric cam 574 are fixed to the same axis. An output shaft 574A of the fourth eccentric cam 574 is eccentric with respect to the rotational center axis of the fourth massaging gear 560.

Therefore, the output shaft 574A revolves with respect to the rotational center axis of the fourth eccentric cam 574. A bottom surface of the fourth massaging element unit 514 is fixed to the output shaft 574A.

Rotation of the rotary drive gear 551 is decelerated via the combination gear 552, the first rotary gear 553, the first accessory gear, the rotation transmission gear 555, and the first massaging gear 556. Rotation of the first massaging gear 556 is transmitted to the first eccentric cam 571. Thus, the first massaging element unit 511 eccentrically rotates integrally with the output shaft 571A.

Further, the rotation of the drive gear 551 is decelerated via the combination gear 552, the first rotary gear 553, the first accessory gear, the rotation transmission gear 555, and the second massaging gear 557. The rotation of the second massaging gear 557 is transmitted to the second eccentric cam 572. Thus, the second massaging element unit 512 eccentrically rotates integrally with the output shaft 572A.

Further, the rotation of the drive gear 551 is decelerated via the combination gear 552, the first rotary gear 553, the second rotary gear 554, the second accessory gear, the rotation transmission gear 558, and the third massaging gear 559. The rotation of the third massaging gear 559 is transmitted to the third eccentric cam 573. Thus, the third massaging element unit 513 eccentrically rotates integrally with the output shaft 573A.

Further, the rotation of the rotary drive gear 551 is decelerated via the combination gear 552, the first rotary gear 553, the second rotary gear 554, the second accessory gear, the rotation transmission gear 558, and the fourth massaging gear 560. The rotation of the fourth massaging gear 560 is transmitted to the fourth eccentric cam 574. Thus, the fourth massaging element unit 514 eccentrically rotates integrally with the output shaft 574A.

In this manner, the rotation of the rotary drive gear 551 is transmitted to the first to fourth massaging element units 511 to 514. The reduction gear ratio between the rotary drive gear 551 and each of the eccentric cams 571 to 574 is preferably included within the range of 30 to 120. For example, the reduction gear ratio is set to 60. The reduction gear ratio between the rotary drive gear 551 and each of the eccentric cams 571 to 574 is substantially the same as the reduction gear ratio between the rotary drive gear 551 and each of the massaging gears 556, 557, 559, and 560.

The arms 531A are coupled to the first rotor 531. Similarly, the arms 532A are connected to the second rotor 532. Furthermore, the pillar 531B is coupled to the distal end portion of the arm 531A. Similarly, the pillar 532B is coupled to the distal end portion of the arm 532A. The arms 531A and 532A and the pillars 531B and 532B have the same structures as those of the arms 131A and 132A and the pillars 131B and 132B in the first embodiment.

The operation of the cosmetic device 5 will be described referring to FIG. 27. When the motor 51 is driven, the driving force of the motor 51 is transmitted to the plurality of the gears 550 of the drive unit 540. As a result, the agitating and mixing mechanism 530 and the massaging unit 510 are driven. Specifically, the first and second rotors 531 and 532 rotate, and the first to fourth massaging element units 511 to 514 rotate.

By rotation of the first and second rotors 531 and 532, the liquid foaming agent stored in the container 580 is mechanically agitated. Thus, the liquid foaming agent and air are mixed with each other to generate the bubbles. The bubbles are discharged to the outside of the massaging unit 510 from the discharge port 581.

By driving the motor 51, each of the massaging element units 511 to 514 being in contact with the skin imparts the soft physical stimulation to the skin. At this time, since the bubbles supplied from the discharge port 581 are supplied to the skin and the massaging unit 510, the scalp is cleaned in accordance with the massage of the scalp. The cosmetic device 5 of the fifth embodiment has the advantages according to (1) to (11) obtained by the cosmetic device 1 of the first embodiment.

It should be apparent to those skilled in the art that the invention may be embodied in many other specific forms without departing from the spirit or scope of the invention. Particularly, it should be understood that the invention may be embodied in the following forms.

In the cosmetic device 5 of the fifth embodiment, the head block 500 and the main body block 50 may be separable from each other. In this case, the head block 500 may have an attachment structure that is attachable and detachable to and from the main body block 10 of the first embodiment. According to this modified example, the motor 13 included in the main body block 10 drives the head block 500 that is the cosmetic unit according to the fifth embodiment.

The cosmetic device 1 of the first embodiment may include a separate motor (second motor), in addition to the motor 13 (first motor). In this case, the first motor 13 may drive the brush unit 110, and meanwhile, the second motor may drive the agitating and mixing mechanism 130. Even in the cosmetic devices 2 to 5 according to the second to fifth embodiments, two motors may be provided as in this modified example.

The cosmetic device 1 of the first embodiment may include the cosmetic unit other than the cosmetic unit illustrated in each of the embodiments. FIGS. 29 to 32 illustrate examples of various cosmetic units.

Figure 29:
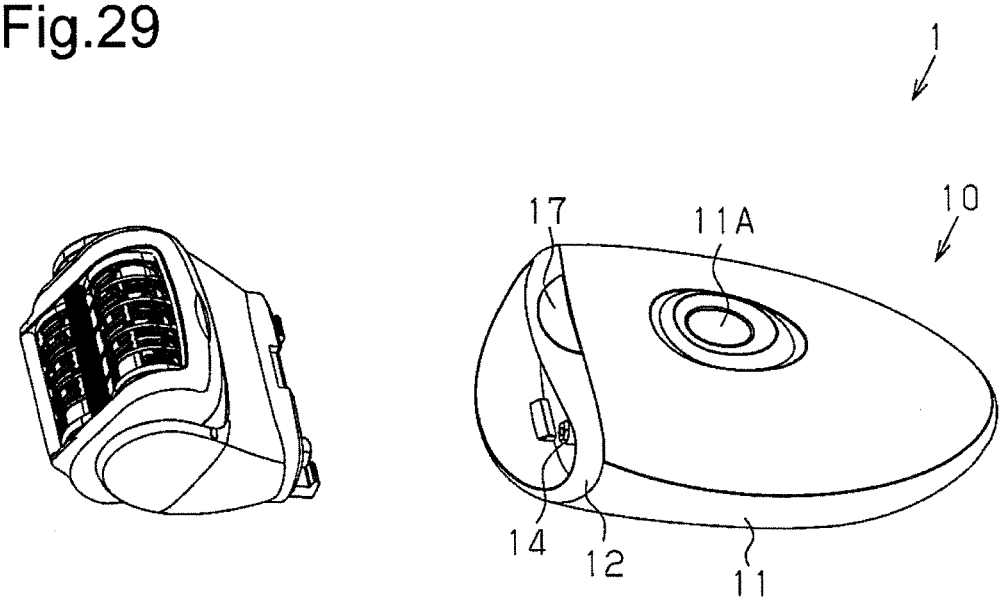
FIGS. 29 to 32 are exploded perspective views of cosmetic devices of various modified examples.

The cosmetic unit illustrated in FIG. 29 is a hair depilation unit. In this modified example, for example, the cosmetic device may perform the hair depilation of legs or arms, by driving the hair depilation unit. The hair depilation in the cosmetic device of this modified example means an operation of pulling out the hair.

Figure 30:
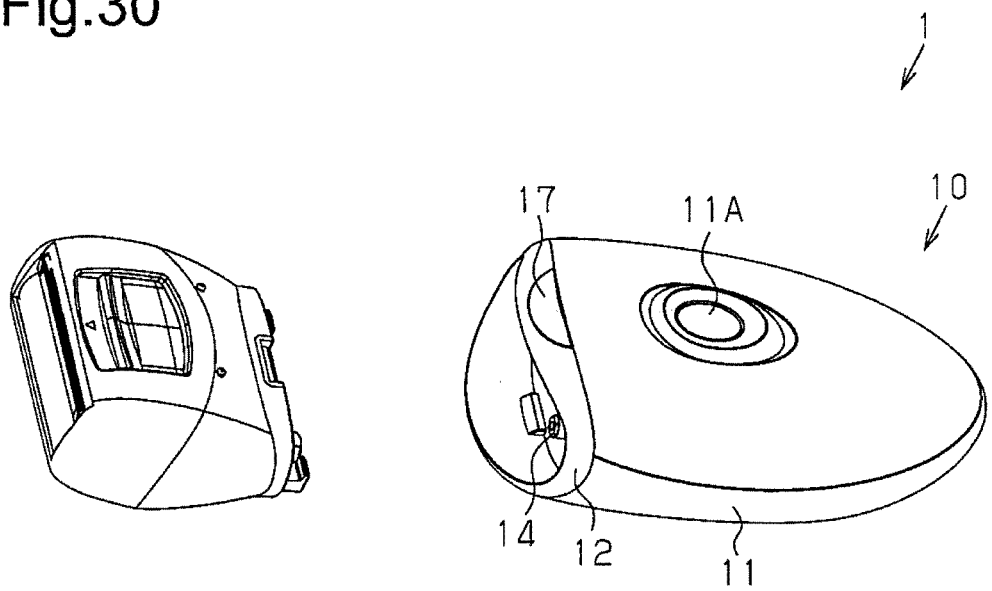

The cosmetic unit illustrated in FIG. 30 is a hair removal unit. In this modified example, for example, the cosmetic device may perform the hair removal of legs or arms by driving the hair removal unit. The hair removal in the hair cosmetic device of this modified example means an operation of cutting the hair.

Figure 31:
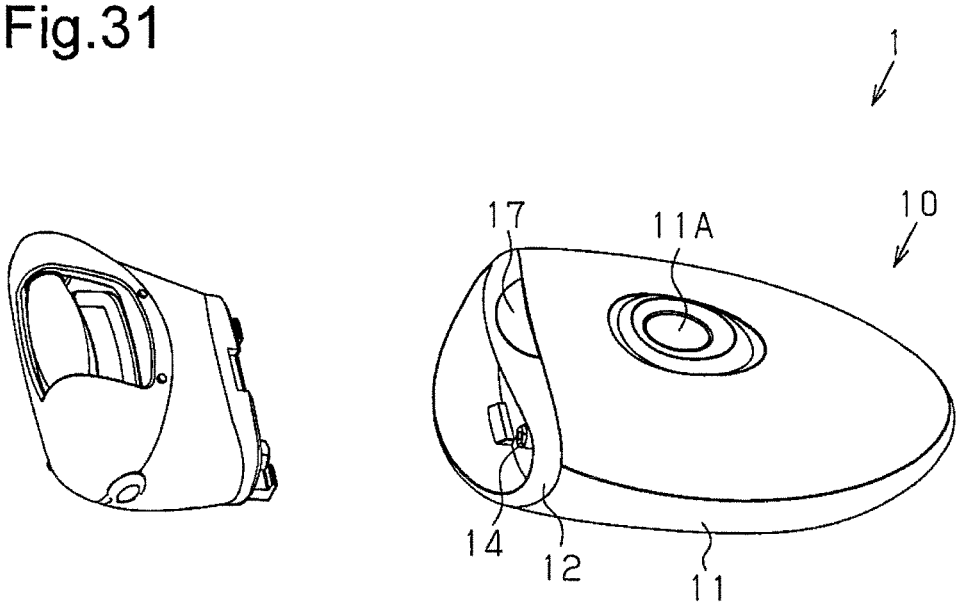

The cosmetic unit illustrated in FIG. 31 is a file unit. In this modified example, the cosmetic device is able to remove, for example, the horny of the skin, by driving the file unit.

Figure 32:
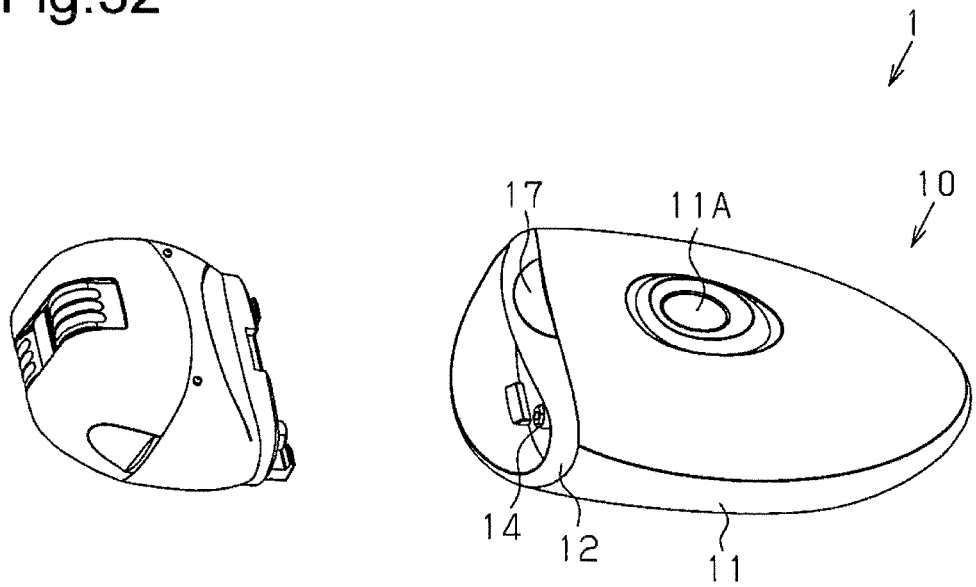

The cosmetic unit illustrated in FIG. 32 is an armpit hair depilation unit. In this modified example, the cosmetic device is able to perform the hair depilation of the armpit by driving the armpit hair depilation unit. The hair depilation in the cosmetic device of this modified example means an operation of pulling out the hair.

In the cosmetic device of the modified examples of FIGS. 29 to 32, the head block may include a bubble generator, and the head block may not include a bubble generator. If the bubble generator is included, the bubble generator may be the bubble generator 120 of the first embodiment as an example.

The container 170 of the first embodiment may have a plate having a grid or a hole, in place of or in addition to the crosspiece 183. It is also possible to apply this modified example to the cosmetic devices 2 to 5 according to the second to fifth embodiments.

The cosmetic device 1 of the first embodiment may also have a bearing made of resin, in place of the bearing 184 made of metal. It is also possible to apply this modified example to the cosmetic devices 2 to 5 according to the second to fifth embodiments.

The cosmetic device 1 of the first embodiment may be configured so that a cosmetic unit having a puff, a file or a rubber material is attachable or detachable in place of the brush unit 110. The cosmetic device 1 of this modified example is able to remove, for example, horny of the skin, by driving the cosmetic unit.

In each of the above-described embodiments, the number of arms coupled to each rotor may arbitrarily change. For example, in the first embodiment, the number of arms 131A coupled to the first rotor 131 may be one. The same also applies to the number of arms coupled to other rotors.

In each of the above-described embodiments, the pillars are not limited to the structure of being coupled to the distal end portion of each arm. Furthermore, the angle formed between the pillar and the arm is not limited to 90. The pillars may be bent to each arm at any angle.

The invention may also be applied to a pet haircutting device and a cleaning device and the like in addition to the cosmetic device, and may also be applied to a device having a function for discharging bubbles other than these devices.

The invention claimed is:

1. A cosmetic device comprising:

a bubble generator configured to generate bubbles;

a cosmetic unit configured to exert a cosmetic effect on a skin; and a motor configured to drive at least the cosmetic unit, wherein the bubble generator includes an agitating and mixing mechanism configured to agitate a liquid foaming agent and mix the agitated liquid foaming agent with air, the agitating and mixing mechanism includes at least two rotors, the at least two rotors include first and second rotors configured to rotate in opposite directions to each other, and the agitation and mixing mechanism includes at least one arm that protrudes from at least one of the first and second rotors.

2. The cosmetic device according to claim 1, wherein each of the first and second rotors includes at least one arm so that a rotational orbit of the arm protruding from the first rotor partially overlaps a rotational orbit of the arm protruding from the second rotor.

3. The cosmetic device according to claim 1, wherein the agitating and mixing mechanism includes a pillar that is coupled to the arm and bent with respect to the arm.

4. The cosmetic device according to claim 3, wherein the pillar has a shape tapered toward a rotational direction of the corresponding rotor.

5. The cosmetic device according to claim 1, wherein the bubble generator includes a discharge port configured to discharges the bubbles, and the discharge port is arranged so that a center of the discharge port is located at a position which is offset from a line segment connecting rotational center axes of the first and second rotors and at which the liquid foaming agent agitated by the first and second rotors is converged.

6. The cosmetic device according to claim 1, wherein the bubble generator includes a suction port configured to suck air, and the suction port is arranged so that a center of the suction port is located at a position which is offset from a line segment connecting rotational center axes of the first and second rotors and at which the liquid foaming agent agitated by the first and second rotors is diffused.

7. A cosmetic device comprising:

a bubble generator configured to generate bubbles;

a cosmetic unit configured to exert a cosmetic effect on a skin; and a motor configured to drive at least the cosmetic unit, wherein the bubble generator includes an agitating and mixing mechanism configured to agitate a liquid foaming agent and mix the agitated liquid foaming agent with air, the agitating and mixing mechanism includes at least two rotors, the at least two rotors include first and second rotors configured to rotate in opposite directions to each other, the bubble generator includes a discharge port configured to discharges the bubbles, and the discharge port is arranged so that a center of the discharge port is located at a position which is offset from a line segment connecting rotational center axes of the first and second rotors and at which the liquid foaming agent agitated by the first and second rotors is converged.

8. The cosmetic device according to claim 7, wherein the agitation and mixing mechanism includes at least one arm that protrudes from at least one of the first and second rotors.

9. The cosmetic device according to claim 7, wherein each of the first and second rotors includes at least one arm so that a rotational orbit of the arm protruding from the first rotor partially overlaps a rotational orbit of the arm protruding from the second rotor.

10. The cosmetic device according to claim 7, wherein the agitating and mixing mechanism includes a pillar that is coupled to the arm and bent with respect to the arm.

11. The cosmetic device according to claim 10, wherein the pillar has a shape tapered toward a rotational direction of the corresponding rotor.

12. The cosmetic device according to claim 7, wherein the bubble generator includes a suction port configured to suck air, and the suction port is arranged so that a center of the suction port is located at a position which is offset from a line segment connecting rotational center axes of the first and second rotors and at which the liquid foaming agent agitated by the first and second rotors is diffused.

13. A cosmetic device comprising:

a bubble generator configured to generate bubbles;

a cosmetic unit configured to exert a cosmetic effect on a skin; and a motor configured to drive at least the cosmetic unit, wherein the bubble generator includes an agitating and mixing mechanism configured to agitate a liquid foaming agent and mix the agitated liquid foaming agent with air, the agitating and mixing mechanism includes at least two rotors, the at least two rotors include first and second rotors configured to rotate in opposite directions to each other, the bubble generator includes a suction port configured to suck air, and the suction port is arranged so that a center of the suction port is located at a position which is offset from a line segment connecting rotational center axes of the first and second rotors and at which the liquid foaming agent agitated by the first and second rotors is diffused.

14. The cosmetic device according to claim 13, wherein the agitation and mixing mechanism includes at least one arm that protrudes from at least one of the first and second rotors.

15. The cosmetic device according to claim 13, wherein each of the first and second rotors includes at least one arm so that a rotational orbit of the arm protruding from the first rotor partially overlaps a rotational orbit of the arm protruding from the second rotor.

16. The cosmetic device according to claim 13, wherein the agitating and mixing mechanism includes a pillar that is coupled to the arm and bent with respect to the arm.

17. The cosmetic device according to claim 16, wherein the pillar has a shape tapered toward a rotational direction of the corresponding rotor.

18. The cosmetic device according to claim 13, wherein the bubble generator includes a discharge port configured to discharges the bubbles, and the discharge port is arranged so that a center of the discharge port is located at a position which is offset from a line segment connecting rotational center axes of the first and second rotors and at which the liquid foaming agent agitated by the first and second rotors is converged.

* * * * *